US012582872B2

(12) United States Patent
Aoki et al.

(10) Patent No.: US 12,582,872 B2
(45) Date of Patent: Mar. 24, 2026

(54) PROCESSING SYSTEM, PROCESSING METHOD, AND NON-TRANSITORY STORAGE MEDIUM

(71) Applicant: TOYOTA JIDOSHA KABUSHIKI KAISHA, Toyota (JP)

(72) Inventors: Eisuke Aoki, Toyota (JP); Yuko Nakahira, Nagakute (JP); Daisuke Yamada, Nagakute (JP); Hidekazu Nishigaki, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 236 days.

(21) Appl. No.: 17/947,305

(22) Filed: Sep. 19, 2022

(65) Prior Publication Data

US 2023/0149776 A1 May 18, 2023

(30) Foreign Application Priority Data

Nov. 12, 2021 (JP) ..... 2021-184937

(51) Int. Cl.
*A63B 21/00* (2006.01)
*A63B 24/00* (2006.01)

(52) U.S. Cl.
CPC ..... *A63B 24/0075* (2013.01); *A63B 21/4034* (2015.10); *A63B 24/0006* (2013.01); *A63B 24/0062* (2013.01); *A63B 2024/0015* (2013.01); *A63B 2024/0065* (2013.01)

(58) Field of Classification Search
None
See application file for complete search history.

(56) References Cited

U.S. PATENT DOCUMENTS 5,529,554 A * 6/1996 Eschenbach ..... A63B 22/0664 482/57
7,201,705 B2 * 4/2007 Rodgers, Jr. ..... A63B 22/208 482/52
10,569,124 B2 * 2/2020 Dalmia ..... A63B 22/0664
2004/0266588 A1 * 12/2004 Miller ..... A63B 22/001 482/52
2006/0094569 A1 * 5/2006 Day ..... A63B 24/00 482/57

(Continued)

FOREIGN PATENT DOCUMENTS

CN 101618261 A * 1/2010
JP 2000-095100 A 4/2000

(Continued)

OTHER PUBLICATIONS

"Pedaling with Hamstrings," Nov. 14, 2018, URL: [https://pdtune.com/ride/pedalinghamstrings/].

(Continued)

*Primary Examiner* — Shila Jalalzadeh Abyaneh
(74) *Attorney, Agent, or Firm* — Oliff PLC

(57) ABSTRACT

A processing system includes a processor. The processor is configured to: acquire user data including physical information of a user; acquire muscle site data on a muscle site desired to be built and an amount of load to be placed on the muscle site; calculate a recommended setting of training equipment that places the load to a muscle of the user, based on the user data and the muscle site data; and output the recommended setting.

5 Claims, 22 Drawing Sheets

(56) References Cited

U.S. PATENT DOCUMENTS

| | | | | |
|---|---|---|---|---|
| 2008/0194388 | A1* | 8/2008 | Chen | A63B 22/0664 482/52 |
| 2010/0010397 | A1* | 1/2010 | Ochi | A61H 1/005 601/27 |
| 2010/0262048 | A1* | 10/2010 | Shinomiya | A61H 1/005 601/35 |
| 2011/0105962 | A1* | 5/2011 | Ochi | A63B 21/00178 601/5 |
| 2011/0152033 | A1* | 6/2011 | Yang | A63B 71/0622 482/8 |
| 2019/0366155 | A1 | 12/2019 | Takizawa | |

FOREIGN PATENT DOCUMENTS

| | | | | | |
|---|---|---|---|---|---|
| JP | 2003116822 | | * | 4/2003 | |
| JP | 2003116822 | A | * | 4/2003 | |
| JP | 2019501684 | A | * | 1/2016 | A63B 69/0062 |
| WO | WO-2016073857 | A1 | * | 5/2016 | A63B 21/0051 |

OTHER PUBLICATIONS

Zeng, Daxing et al: "A New Type of Ankle-Foot Rehabilitation Robot Based on Muscle Motor Characteristics", IEEE Access, IEEE, USA, vol. 8, Nov. 26, 2020, pp. 215915-215927.

* cited by examiner

FIG. 13

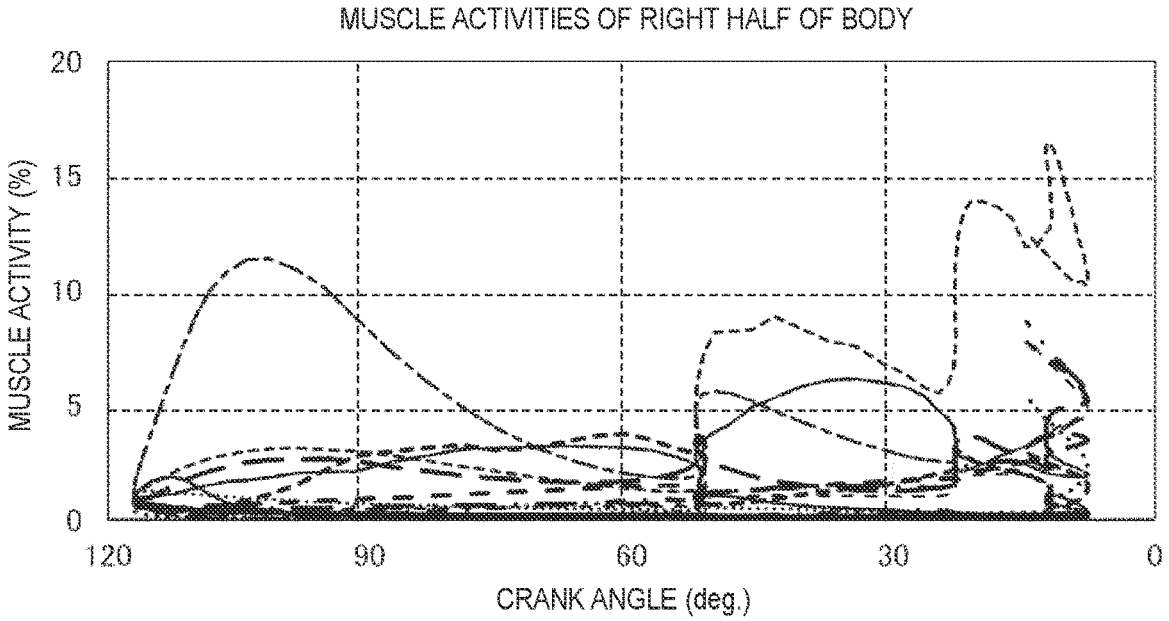

- RECTUS ABDOMINIS (TRUNK: LEAN FORWARD) RIGHT
- RECTUS FEMORIS (HIP: FLEXED, KNEE: EXTENDED) RIGHT
- SOLEUS (FOOT: PLANTARFLEXED, DEEP MUSCLE) RIGHT
- PSOAS MAJOR (HIP: FLEXED, DEEP MUSCLE) RIGHT
- VASTUS MEDIALIS (KNEE: EXTENDED) RIGHT
- GLUTEUS MEDIUS (HIP: ABDUCTED, DEEP MUSCLE) RIGHT
- ILIACUS (HIP: FLEXED, DEEP MUSCLE) RIGHT
- OBTURATORIUS EXTERNUS (HIP: ABDUCTED, DEEP MUSCLE) RIGHT
- ADDUCTOR BREVIS (HIP: ADDUCTED, DEEP MUSCLE) RIGHT
- POPLITEUS (KNEE: FLEXED, DEEP MUSCLE) RIGHT
- ERECTOR SPINAE (TRUNK: LEANED BACKWARD) RIGHT
- BICEPS FEMORIS (HIP: EXTENDED, KNEE: FLEXED) RIGHT
- TIBIALIS ANTERIOR (FOOT: DORSIFLEXED) RIGHT
- GLUTEUS MAXIMUS (HIP: EXTENDED) RIGHT
- GASTROCNEMIUS (KNEE: FLEXED, FOOT: PLANTARFLEXED) RIGHT
- GLUTEUS MINIMUS (HIP: ABDUCTED, DEEP MUSCLE) RIGHT
- QUADRATUS FEMORIS (HIP: LATERALLY ROTATED, DEEP MUSCLE) RIGHT
- VASTUS INTERMEDIUS (KNEE: EXTENDED, DEEP MUSCLE) RIGHT
- PLANTARIS (FOOT: PLANTARFLEXED, DEEP MUSCLE) RIGHT
- PSOAS MAJOR (HIP: FLEXED, DEEP MUSCLE) RIGHT

FIG. 14

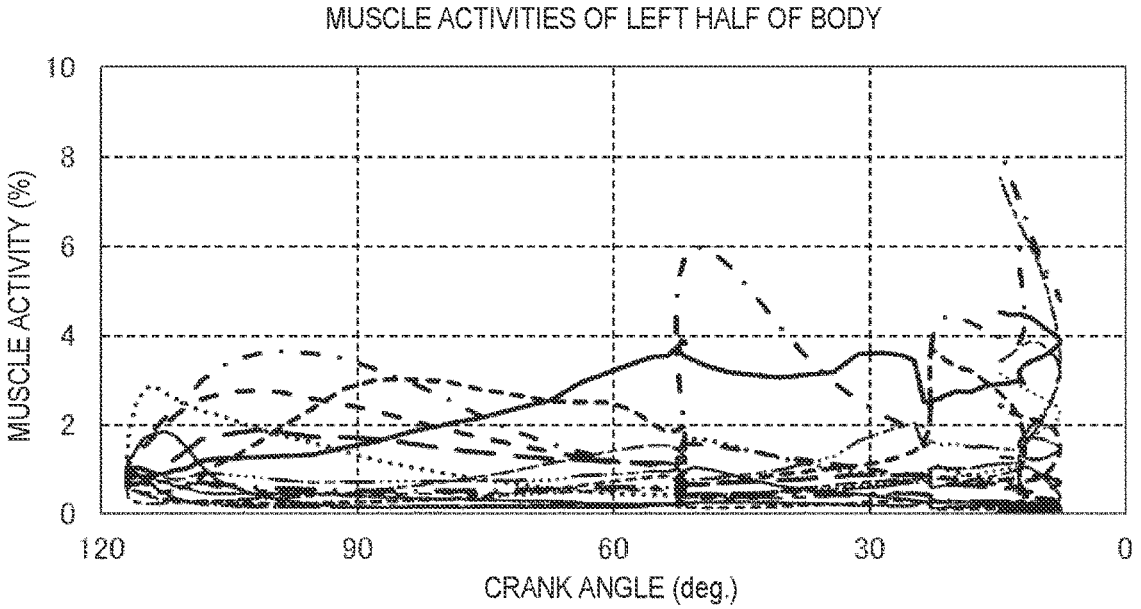

- RECTUS ABDOMINIS (TRUNK: LEAN FORWARD) LEFT
- RECTUS FEMORIS (HIP: FLEXED, KNEE: EXTENDED) LEFT
- SOLEUS (FOOT: PLANTARFLEXED, DEEP MUSCLE) LEFT
- PSOAS MAJOR (HIP: FLEXED, DEEP MUSCLE) LEFT
- VASTUS MEDIALIS (KNEE: EXTENDED) LEFT
- GLUTEUS MEDIUS (HIP: ABDUCTED, DEEP MUSCLE) LEFT
- ILIACUS (HIP: FLEXED, DEEP MUSCLE) LEFT
- OBTURATORIUS EXTERNUS (HIP: ABDUCTED, DEEP MUSCLE) LEFT
- ADDUCTOR BREVIS (HIP: ADDUCTED, DEEP MUSCLE) LEFT
- POPLITEUS (KNEE: FLEXED, DEEP MUSCLE) LEFT
- ERECTOR SPINAE (TRUNK: LEANED BACKWARD) LEFT
- BICEPS FEMORIS (HIP: EXTENDED, KNEE: FLEXED) LEFT
- TIBIALIS ANTERIOR (FOOT: DORSIFLEXED) LEFT
- GLUTEUS MAXIMUS (HIP: EXTENDED) LEFT
- GASTROCNEMIUS (KNEE: FLEXED, FOOT: PLANTARFLEXED) LEFT
- GLUTEUS MINIMUS (HIP: ABDUCTED, DEEP MUSCLE) LEFT
- QUADRATUS FEMORIS (HIP: LATERALLY ROTATED, DEEP MUSCLE) LEFT
- VASTUS INTERMEDIUS (KNEE: EXTENDED, DEEP MUSCLE) LEFT
- PLANTARIS (FOOT: PLANTARFLEXED, DEEP MUSCLE) LEFT
- PSOAS MAJOR (HIP: FLEXED, DEEP MUSCLE) LEFT

FIG. 15

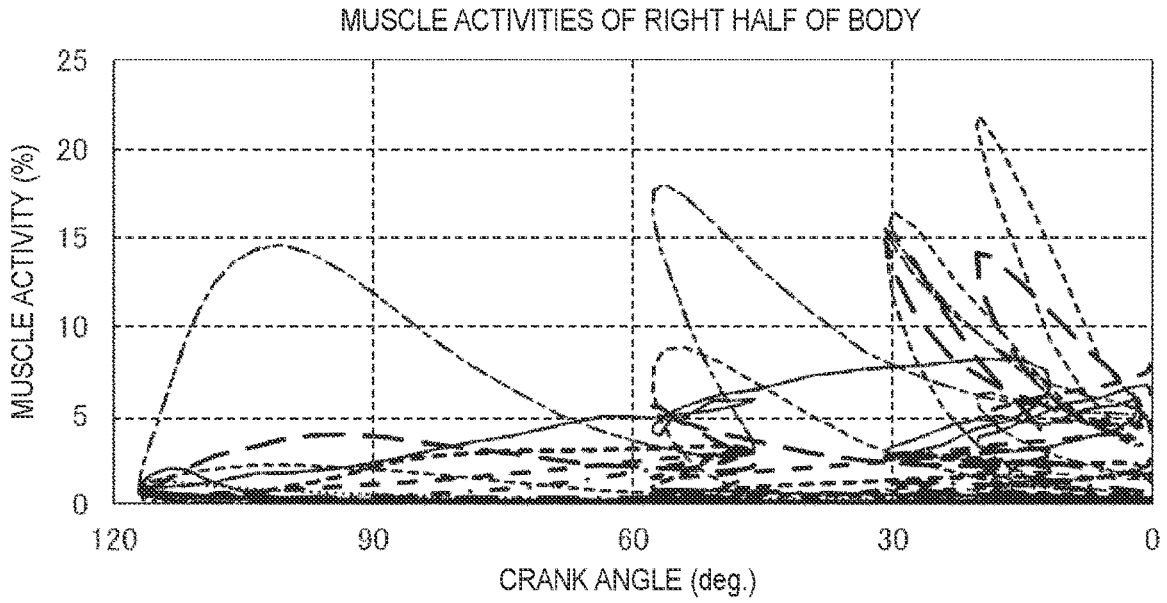

RECTUS ABDOMINIS (TRUNK: LEAN FORWARD) RIGHT
RECTUS FEMORIS (HIP: FLEXED, KNEE: EXTENDED) RIGHT
SOLEUS (FOOT: PLANTARFLEXED, DEEP MUSCLE) RIGHT
PSOAS MAJOR (HIP: FLEXED, DEEP MUSCLE) RIGHT
VASTUS MEDIALIS (KNEE: EXTENDED) RIGHT
GLUTEUS MEDIUS (HIP: ABDUCTED, DEEP MUSCLE) RIGHT
ILIACUS (HIP: FLEXED, DEEP MUSCLE) RIGHT
OBTURATORIUS EXTERNUS (HIP: ABDUCTED, DEEP MUSCLE) RIGHT
ADDUCTOR BREVIS (HIP: ADDUCTED, DEEP MUSCLE) RIGHT
POPLITEUS (KNEE: FLEXED, DEEP MUSCLE) RIGHT
ERECTOR SPINAE (TRUNK: LEANED BACKWARD) RIGHT
BICEPS FEMORIS (HIP: EXTENDED, KNEE: FLEXED) RIGHT
TIBIALIS ANTERIOR (FOOT: DORSIFLEXED) RIGHT
GLUTEUS MAXIMUS (HIP: EXTENDED) RIGHT
GASTROCNEMIUS (KNEE: FLEXED, FOOT: PLANTARFLEXED) RIGHT
GLUTEUS MINIMUS (HIP: ABDUCTED, DEEP MUSCLE) RIGHT
QUADRATUS FEMORIS (HIP: LATERALLY ROTATED, DEEP MUSCLE) RIGHT
VASTUS INTERMEDIUS (KNEE: EXTENDED, DEEP MUSCLE) RIGHT
PLANTARIS (FOOT: PLANTARFLEXED, DEEP MUSCLE) RIGHT
PSOAS MAJOR (HIP: FLEXED, DEEP MUSCLE) RIGHT

FIG. 16

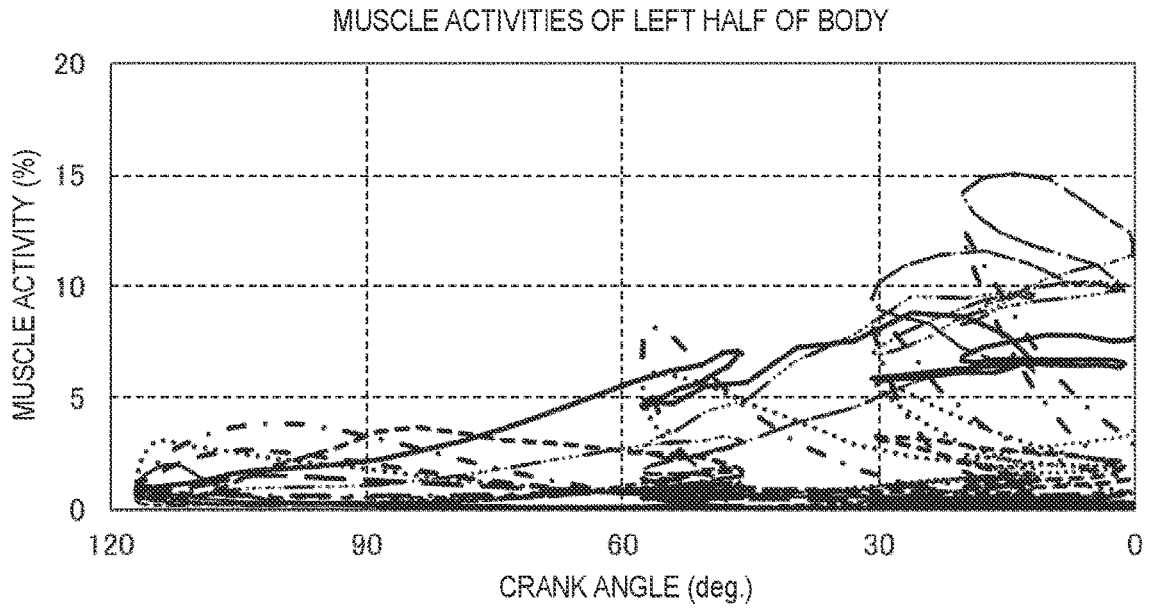

RECTUS ABDOMINIS (TRUNK: LEAN FORWARD) LEFT

RECTUS FEMORIS (HIP: FLEXED, KNEE: EXTENDED) LEFT

SOLEUS (FOOT: PLANTARFLEXED, DEEP MUSCLE) LEFT

PSOAS MAJOR (HIP: FLEXED, DEEP MUSCLE) LEFT

VASTUS MEDIALIS (KNEE: EXTENDED) LEFT

GLUTEUS MEDIUS (HIP: ABDUCTED, DEEP MUSCLE) LEFT

ILIACUS (HIP: FLEXED, DEEP MUSCLE) LEFT

OBTURATORIUS EXTERNUS (HIP: ABDUCTED, DEEP MUSCLE) LEFT

ADDUCTOR BREVIS (HIP: ADDUCTED, DEEP MUSCLE) LEFT

POPLITEUS (KNEE: FLEXED, DEEP MUSCLE) LEFT

ERECTOR SPINAE (TRUNK: LEANED BACKWARD) LEFT

BICEPS FEMORIS (HIP: EXTENDED, KNEE: FLEXED) LEFT

TIBIALIS ANTERIOR (FOOT: DORSIFLEXED) LEFT

GLUTEUS MAXIMUS (HIP: EXTENDED) LEFT

GASTROCNEMIUS (KNEE: FLEXED, FOOT: PLANTARFLEXED) LEFT

GLUTEUS MINIMUS (HIP: ABDUCTED, DEEP MUSCLE) LEFT

QUADRATUS FEMORIS (HIP: LATERALLY ROTATED, DEEP MUSCLE) LEFT

VASTUS INTERMEDIUS (KNEE: EXTENDED, DEEP MUSCLE) LEFT

PLANTARIS (FOOT: PLANTARFLEXED, DEEP MUSCLE) LEFT

PSOAS MAJOR (HIP: FLEXED, DEEP MUSCLE) LEFT

FIG. 17

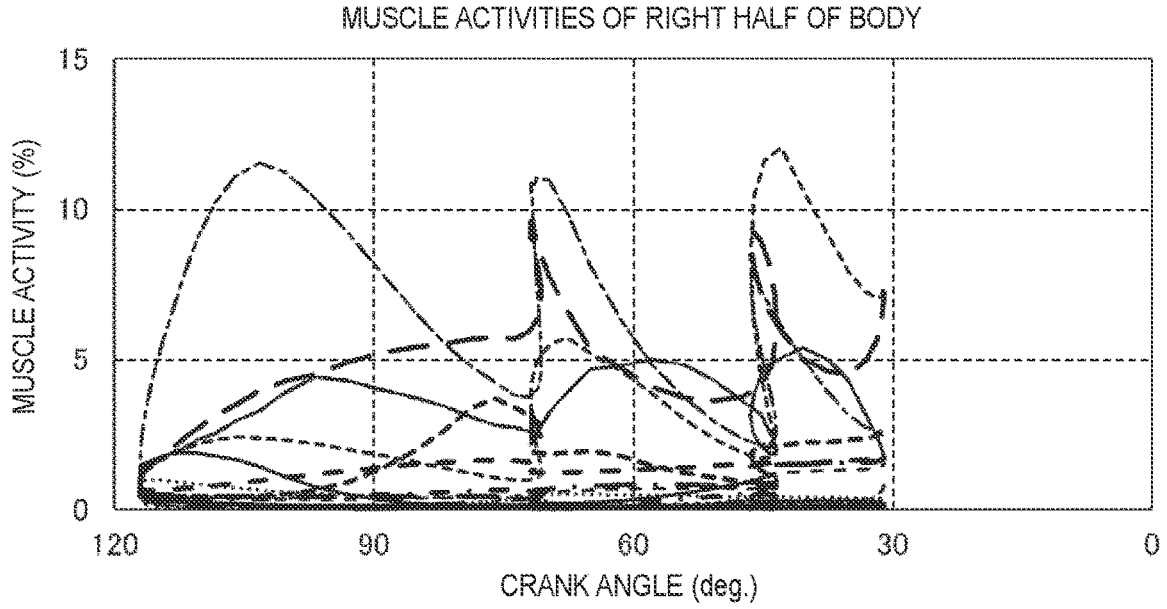

- RECTUS ABDOMINIS (TRUNK: LEAN FORWARD) RIGHT
- RECTUS FEMORIS (HIP: FLEXED, KNEE: EXTENDED) RIGHT
- SOLEUS (FOOT: PLANTARFLEXED, DEEP MUSCLE) RIGHT
- PSOAS MAJOR (HIP: FLEXED, DEEP MUSCLE) RIGHT
- VASTUS MEDIALIS (KNEE: EXTENDED) RIGHT
- GLUTEUS MEDIUS (HIP: ABDUCTED, DEEP MUSCLE) RIGHT
- ILIACUS (HIP: FLEXED, DEEP MUSCLE) RIGHT
- OBTURATORIUS EXTERNUS (HIP: ABDUCTED, DEEP MUSCLE) RIGHT
- ADDUCTOR BREVIS (HIP: ADDUCTED, DEEP MUSCLE) RIGHT
- POPLITEUS (KNEE: FLEXED, DEEP MUSCLE) RIGHT
- ERECTOR SPINAE (TRUNK: LEANED BACKWARD) RIGHT
- BICEPS FEMORIS (HIP: EXTENDED, KNEE: FLEXED) RIGHT
- TIBIALIS ANTERIOR (FOOT: DORSIFLEXED) RIGHT
- GLUTEUS MAXIMUS (HIP: EXTENDED) RIGHT
- GASTROCNEMIUS (KNEE: FLEXED, FOOT: PLANTARFLEXED) RIGHT
- GLUTEUS MINIMUS (HIP: ABDUCTED, DEEP MUSCLE) RIGHT
- QUADRATUS FEMORIS (HIP: LATERALLY ROTATED, DEEP MUSCLE) RIGHT
- VASTUS INTERMEDIUS (KNEE: EXTENDED, DEEP MUSCLE) RIGHT
- PLANTARIS (FOOT: PLANTARFLEXED, DEEP MUSCLE) RIGHT
- PSOAS MAJOR (HIP: FLEXED, DEEP MUSCLE) RIGHT

FIG. 18

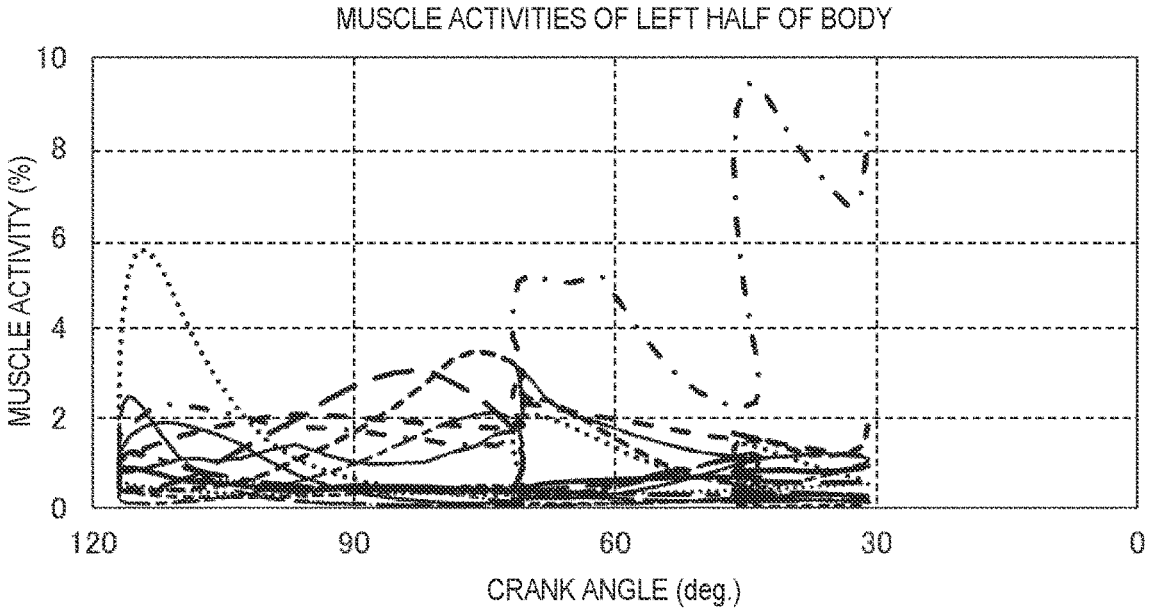

RECTUS ABDOMINIS (TRUNK: LEAN FORWARD) LEFT

RECTUS FEMORIS (HIP: FLEXED, KNEE: EXTENDED) LEFT

SOLEUS (FOOT: PLANTARFLEXED, DEEP MUSCLE) LEFT

PSOAS MAJOR (HIP: FLEXED, DEEP MUSCLE) LEFT

VASTUS MEDIALIS (KNEE: EXTENDED) LEFT

GLUTEUS MEDIUS (HIP: ABDUCTED, DEEP MUSCLE) LEFT

ILIACUS (HIP: FLEXED, DEEP MUSCLE) LEFT

OBTURATORIUS EXTERNUS (HIP: ABDUCTED, DEEP MUSCLE) LEFT

ADDUCTOR BREVIS (HIP: ADDUCTED, DEEP MUSCLE) LEFT

POPLITEUS (KNEE: FLEXED, DEEP MUSCLE) LEFT

ERECTOR SPINAE (TRUNK: LEANED BACKWARD) LEFT

BICEPS FEMORIS (HIP: EXTENDED, KNEE: FLEXED) LEFT

TIBIALIS ANTERIOR (FOOT: DORSIFLEXED) LEFT

GLUTEUS MAXIMUS (HIP: EXTENDED) LEFT

GASTROCNEMIUS (KNEE: FLEXED, FOOT: PLANTARFLEXED) LEFT

GLUTEUS MINIMUS (HIP: ABDUCTED, DEEP MUSCLE) LEFT

QUADRATUS FEMORIS (HIP: LATERALLY ROTATED, DEEP MUSCLE) LEFT

VASTUS INTERMEDIUS (KNEE: EXTENDED, DEEP MUSCLE) LEFT

PLANTARIS (FOOT: PLANTARFLEXED, DEEP MUSCLE) LEFT

PSOAS MAJOR (HIP: FLEXED, DEEP MUSCLE) LEFT

FIG. 19

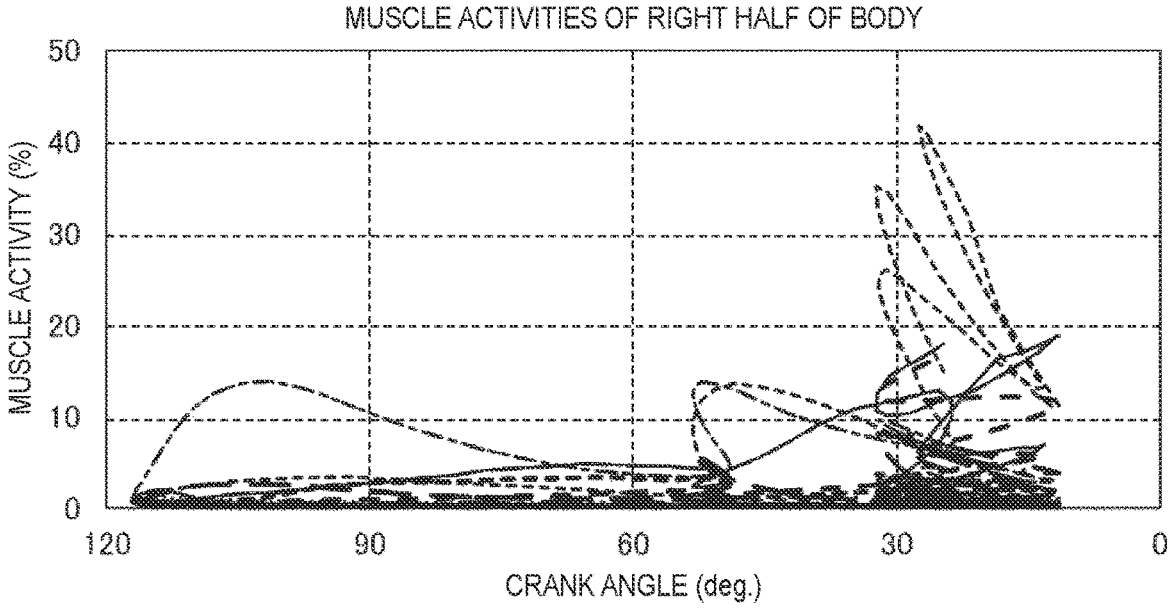

RECTUS ABDOMINIS (TRUNK: LEAN FORWARD) RIGHT
RECTUS FEMORIS (HIP: FLEXED, KNEE: EXTENDED) RIGHT
SOLEUS (FOOT: PLANTARFLEXED, DEEP MUSCLE) RIGHT
PSOAS MAJOR (HIP: FLEXED, DEEP MUSCLE) RIGHT
VASTUS MEDIALIS (KNEE: EXTENDED) RIGHT
GLUTEUS MEDIUS (HIP: ABDUCTED, DEEP MUSCLE) RIGHT
ILIACUS (HIP: FLEXED, DEEP MUSCLE) RIGHT
OBTURATORIUS EXTERNUS (HIP: ABDUCTED, DEEP MUSCLE) RIGHT
ADDUCTOR BREVIS (HIP: ADDUCTED, DEEP MUSCLE) RIGHT
POPLITEUS (KNEE: FLEXED, DEEP MUSCLE) RIGHT
ERECTOR SPINAE (TRUNK: LEANED BACKWARD) RIGHT
BICEPS FEMORIS (HIP: EXTENDED, KNEE: FLEXED) RIGHT
TIBIALIS ANTERIOR (FOOT: DORSIFLEXED) RIGHT
GLUTEUS MAXIMUS (HIP: EXTENDED) RIGHT
GASTROCNEMIUS (KNEE: FLEXED, FOOT: PLANTARFLEXED) RIGHT
GLUTEUS MINIMUS (HIP: ABDUCTED, DEEP MUSCLE) RIGHT
QUADRATUS FEMORIS (HIP: LATERALLY ROTATED, DEEP MUSCLE) RIGHT
VASTUS INTERMEDIUS (KNEE: EXTENDED, DEEP MUSCLE) RIGHT
PLANTARIS (FOOT: PLANTARFLEXED, DEEP MUSCLE) RIGHT
PSOAS MAJOR (HIP: FLEXED, DEEP MUSCLE) RIGHT

FIG. 20

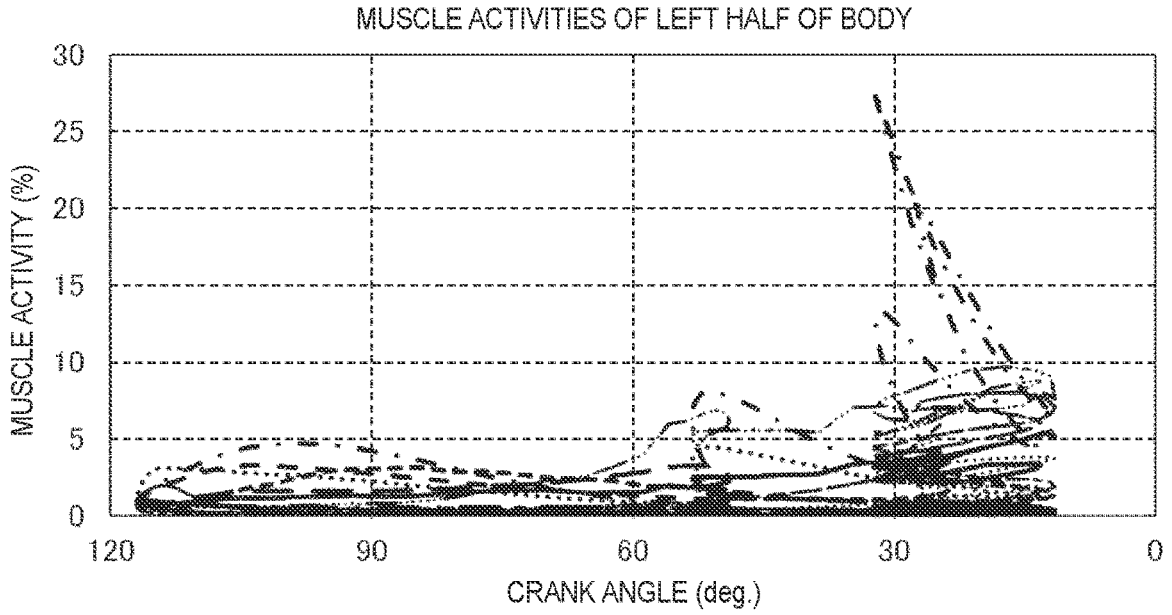

RECTUS ABDOMINIS (TRUNK: LEAN FORWARD) LEFT

RECTUS FEMORIS (HIP: FLEXED, KNEE: EXTENDED) LEFT

SOLEUS (FOOT: PLANTARFLEXED, DEEP MUSCLE) LEFT

PSOAS MAJOR (HIP: FLEXED, DEEP MUSCLE) LEFT

VASTUS MEDIALIS (KNEE: EXTENDED) LEFT

GLUTEUS MEDIUS (HIP: ABDUCTED, DEEP MUSCLE) LEFT

ILIACUS (HIP: FLEXED, DEEP MUSCLE) LEFT

OBTURATORIUS EXTERNUS (HIP: ABDUCTED, DEEP MUSCLE) LEFT

ADDUCTOR BREVIS (HIP: ADDUCTED, DEEP MUSCLE) LEFT

POPLITEUS (KNEE: FLEXED, DEEP MUSCLE) LEFT

ERECTOR SPINAE (TRUNK: LEANED BACKWARD) LEFT

BICEPS FEMORIS (HIP: EXTENDED, KNEE: FLEXED) LEFT

TIBIALIS ANTERIOR (FOOT: DORSIFLEXED) LEFT

GLUTEUS MAXIMUS (HIP: EXTENDED) LEFT

GASTROCNEMIUS (KNEE: FLEXED, FOOT: PLANTARFLEXED) LEFT

GLUTEUS MINIMUS (HIP: ABDUCTED, DEEP MUSCLE) LEFT

QUADRATUS FEMORIS (HIP: LATERALLY ROTATED, DEEP MUSCLE) LEFT

VASTUS INTERMEDIUS (KNEE: EXTENDED, DEEP MUSCLE) LEFT

PLANTARIS (FOOT: PLANTARFLEXED, DEEP MUSCLE) LEFT

PSOAS MAJOR (HIP: FLEXED, DEEP MUSCLE) LEFT

FIG. 21

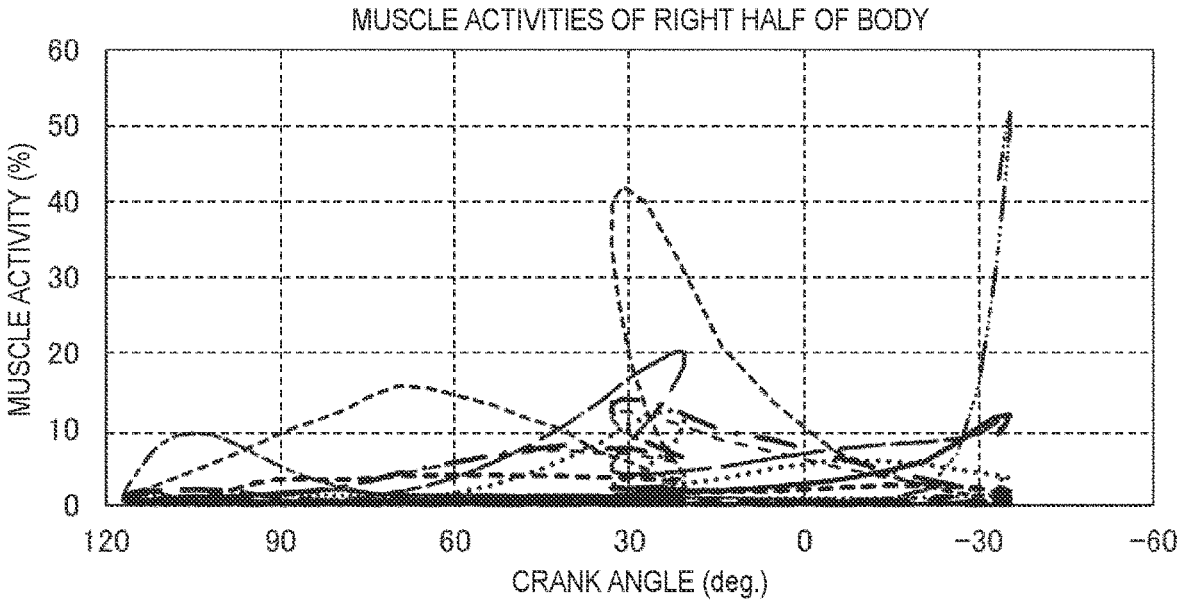

RECTUS ABDOMINIS (TRUNK: LEAN FORWARD) RIGHT
RECTUS FEMORIS (HIP: FLEXED, KNEE: EXTENDED) RIGHT
SOLEUS (FOOT: PLANTARFLEXED, DEEP MUSCLE) RIGHT
PSOAS MAJOR (HIP: FLEXED, DEEP MUSCLE) RIGHT
VASTUS MEDIALIS (KNEE: EXTENDED) RIGHT
GLUTEUS MEDIUS (HIP: ABDUCTED, DEEP MUSCLE) RIGHT
ILIACUS (HIP: FLEXED, DEEP MUSCLE) RIGHT
OBTURATORIUS EXTERNUS (HIP: ABDUCTED, DEEP MUSCLE) RIGHT
ADDUCTOR BREVIS (HIP: ADDUCTED, DEEP MUSCLE) RIGHT
POPLITEUS (KNEE: FLEXED, DEEP MUSCLE) RIGHT
ERECTOR SPINAE (TRUNK: LEANED BACKWARD) RIGHT
BICEPS FEMORIS (HIP: EXTENDED, KNEE: FLEXED) RIGHT
TIBIALIS ANTERIOR (FOOT: DORSIFLEXED) RIGHT
GLUTEUS MAXIMUS (HIP: EXTENDED) RIGHT
GASTROCNEMIUS (KNEE: FLEXED, FOOT: PLANTARFLEXED) RIGHT
GLUTEUS MINIMUS (HIP: ABDUCTED, DEEP MUSCLE) RIGHT
QUADRATUS FEMORIS (HIP: LATERALLY ROTATED, DEEP MUSCLE) RIGHT
VASTUS INTERMEDIUS (KNEE: EXTENDED, DEEP MUSCLE) RIGHT
PLANTARIS (FOOT: PLANTARFLEXED, DEEP MUSCLE) RIGHT
PSOAS MAJOR (HIP: FLEXED, DEEP MUSCLE) RIGHT

FIG. 22

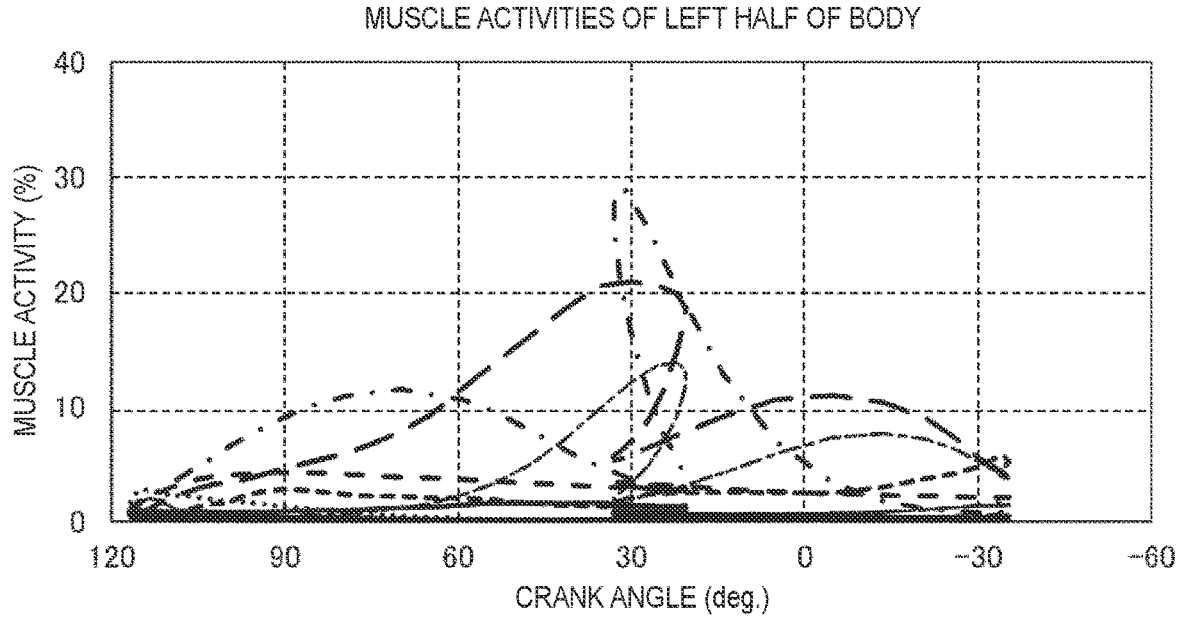

RECTUS ABDOMINIS (TRUNK: LEAN FORWARD) LEFT

RECTUS FEMORIS (HIP: FLEXED, KNEE: EXTENDED) LEFT

SOLEUS (FOOT: PLANTARFLEXED, DEEP MUSCLE) LEFT

PSOAS MAJOR (HIP: FLEXED, DEEP MUSCLE) LEFT

VASTUS MEDIALIS (KNEE: EXTENDED) LEFT

GLUTEUS MEDIUS (HIP: ABDUCTED, DEEP MUSCLE) LEFT

ILIACUS (HIP: FLEXED, DEEP MUSCLE) LEFT

OBTURATORIUS EXTERNUS (HIP: ABDUCTED, DEEP MUSCLE) LEFT

ADDUCTOR BREVIS (HIP: ADDUCTED, DEEP MUSCLE) LEFT

POPLITEUS (KNEE: FLEXED, DEEP MUSCLE) LEFT

ERECTOR SPINAE (TRUNK: LEANED BACKWARD) LEFT

BICEPS FEMORIS (HIP: EXTENDED, KNEE: FLEXED) LEFT

TIBIALIS ANTERIOR (FOOT: DORSIFLEXED) LEFT

GLUTEUS MAXIMUS (HIP: EXTENDED) LEFT

GASTROCNEMIUS (KNEE: FLEXED, FOOT: PLANTARFLEXED) LEFT

GLUTEUS MINIMUS (HIP: ABDUCTED, DEEP MUSCLE) LEFT

QUADRATUS FEMORIS (HIP: LATERALLY ROTATED, DEEP MUSCLE) LEFT

VASTUS INTERMEDIUS (KNEE: EXTENDED, DEEP MUSCLE) LEFT

PLANTARIS (FOOT: PLANTARFLEXED, DEEP MUSCLE) LEFT

PSOAS MAJOR (HIP: FLEXED, DEEP MUSCLE) LEFT

PROCESSING SYSTEM, PROCESSING METHOD, AND NON-TRANSITORY STORAGE MEDIUM

CROSS-REFERENCE TO RELATED APPLICATION

This application claims priority to Japanese Patent Application No. 2021-184937 filed on Nov. 12, 2021, incorporated herein by reference in its entirety.

BACKGROUND

1. Technical Field

The present disclosure relates to processing systems, processing methods, and non-transitory storage media.

2. Description of Related Art

Japanese Unexamined Patent Application Publication No. 2000-95100 (JP 2000-95100 A) discloses a moving device using a pedaling exercise. The experimental results of pedaling using hamstrings are shown at https://pdtune.com/ride/pedalinghamstrings/(accessed Sep. 15, 2020). A change in myoelectric potential according to the rotation angle of a pedal is described for each muscle.

SUMMARY

A user performs a pedaling exercise in order to maintain or increase muscular strength. Exercise equipment like pedal exercisers are desired to allow users to exercise more effectively. For example, by setting an appropriate load level according to the user, the user can do training suitable for him or her.

The present disclosure provides a processing system, processing method, and non-transitory storage media that allow a user to train effectively.

A processing system according to a first embodiment includes a processor. The processor is configured to: acquire user data including physical information of a user; acquire muscle site data on a muscle site desired to be built and an amount of load to be placed on the muscle site; calculate a recommended setting of training equipment that places the load to a muscle of the user, based on the user data and the muscle site data; and output the recommended setting.

In the processing system according to the first embodiment, a setting item of the training equipment may be linked to the muscle site.

In the processing system according to the first embodiment, the processor may be configured to calculate the recommended setting from a simulation result of simulating a load placed on each of muscle sites by changing a parameter of the setting item of the training equipment.

In the processing system according to the first embodiment, the muscle site desired to be built may include a deep muscle.

In the processing system according to the first embodiment, the processor may be configured to determine whether the training equipment is operating with the recommended setting.

A processing method according to a second embodiment includes: acquiring user data including physical information of a user; acquiring muscle site data on a muscle site desired to be built and an amount of load to be placed on the muscle site; calculating a recommended setting of training equipment that places the load on a muscle of the user, based on the user data and the muscle site data; and outputting the recommended setting.

In the processing method according to the second embodiment, a setting item of the training equipment may be linked to the muscle site.

In the processing method according to the second embodiment, the recommended setting may be calculated from a simulation result of simulating a load placed on each of muscle sites by changing a parameter of the setting item of the training equipment.

In the processing method according to the second embodiment, the muscle site desired to be built may include a deep muscle.

The processing method according to the second embodiment may further include determining whether the training equipment is operating with the recommended setting.

A non-transitory storage medium according to a third embodiment stores instructions that are executable by one or more processors and that cause the one or more processors to perform functions. The functions include: acquiring user data including physical information of a user; acquiring muscle site data on a muscle site desired to be built and an amount of load to be placed on the muscle site; calculating a recommended setting of training equipment that places the load on a muscle of the user, based on the user data and the muscle site data; and outputting the recommended setting.

In the non-transitory storage medium according to the third embodiment, a setting item of the training equipment may be linked to the muscle site.

In the non-transitory storage medium according to the third embodiment, the recommended setting may be calculated from a simulation result of simulating a load placed on each of muscle sites by changing a parameter of the setting item of the training equipment.

In the non-transitory storage medium according to the third embodiment, the muscle site desired to be built may include a deep muscle.

In the non-transitory storage medium according to the third embodiment, the functions may further include determining whether the training equipment is operating with the recommended setting.

The present disclosure provides a processing system, processing method, and non-transitory storage medium that allow a user to train effectively.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein:

FIG. 13 is a graph showing simulation results of a simulator;

FIG. 14 is a graph showing simulation results of the simulator;

FIG. 15 is a graph showing simulation results of the simulator;

FIG. 16 is a graph showing simulation results of the simulator;

FIG. 17 is a graph showing simulation results of the simulator;

FIG. 18 is a graph showing simulation results of the simulator;

FIG. 19 is a graph showing simulation results of the simulator;

FIG. 20 is a graph showing simulation results of the simulator;

FIG. 21 is a graph showing simulation results of the simulator; and

FIG. 22 is a graph showing simulation results of the simulator.

DETAILED DESCRIPTION OF EMBODIMENTS

Hereinafter, the present disclosure will be described through an embodiment. However, the present disclosure according to the claims is not limited to the following embodiment. Not all of the configurations described in the embodiment are essential as means for solving the problem. For the sake of clarity, the following description and drawings are omitted or simplified as appropriate. The same elements are denoted by the same reference signs throughout the drawings, and duplicate descriptions will be omitted as necessary.

First Embodiment

In the present embodiment, a pedal exerciser will be described as an example of the training equipment. The training equipment is a pedal exerciser (hereinafter sometimes simply referred to as the "exerciser") for a user to perform a pedaling exercise. A processing system and processing method according to the present embodiment perform a process of providing recommended settings for setting items of the pedal exerciser for training with the pedal exerciser. For example, the processing system outputs recommended settings to a person who performs a pedaling exercise and an assistant who assists in the training. The person who does a pedaling exercise can thus train under appropriate load.

Figure 1:
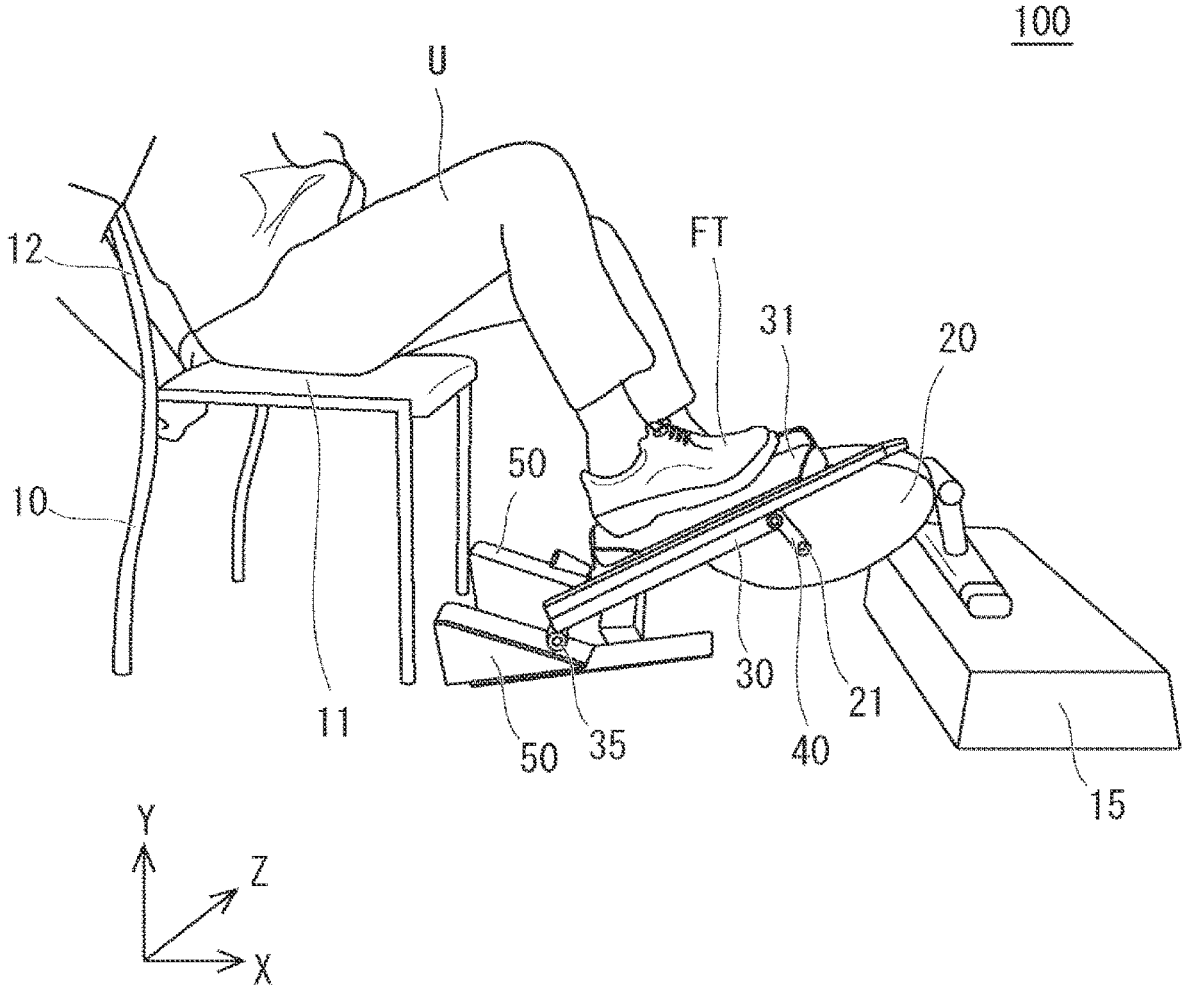
FIG. 1 is a perspective view schematically showing a configuration of an exerciser.
Figure 2:
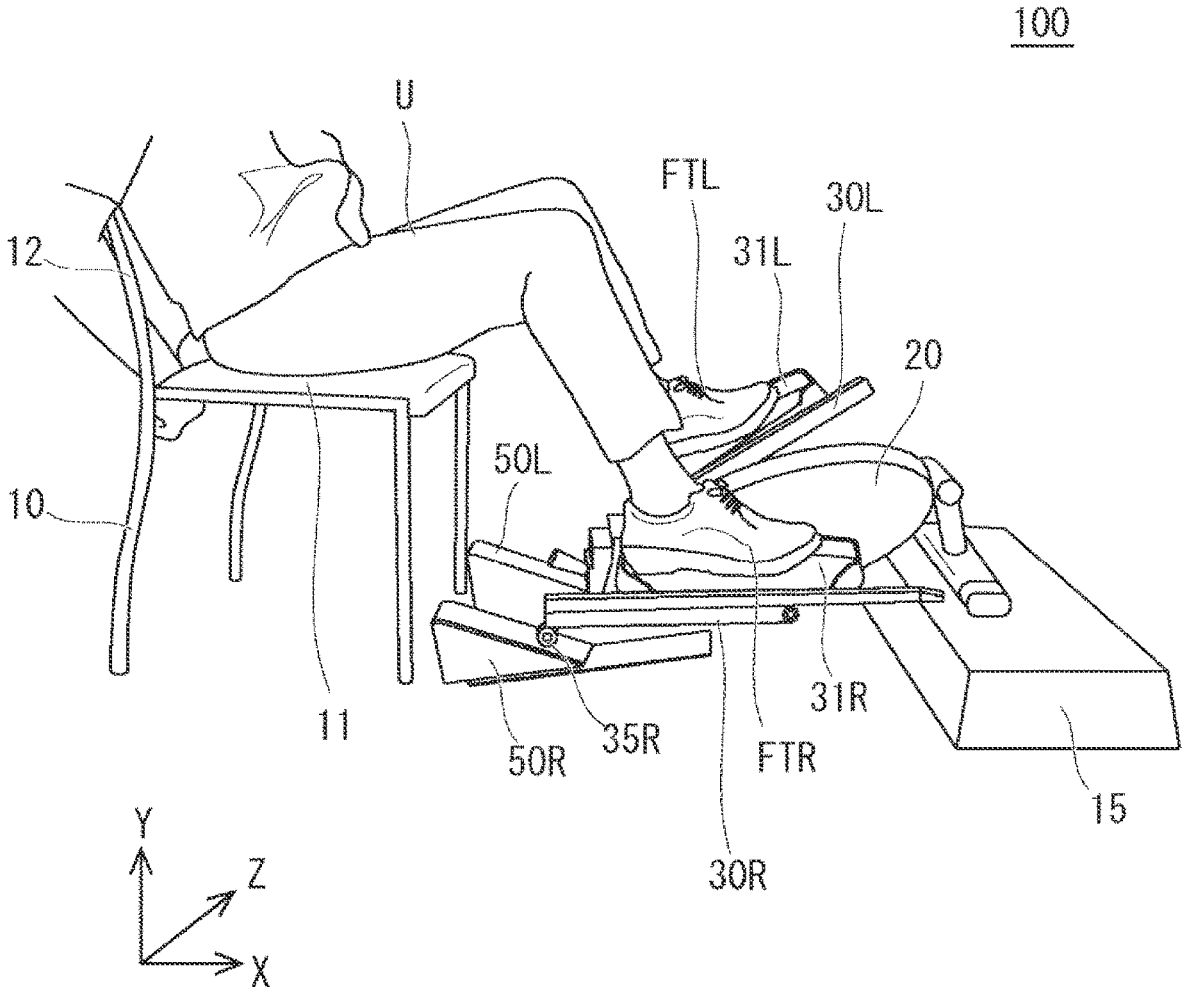
FIG. 2 is a perspective view schematically showing the configuration of the exerciser.

An exerciser 100 will be described with reference to FIGS. 1 and 2. FIGS. 1 and 2 show the exerciser 100 as viewed from the side. For clarity of explanation, the following description will be given using a three-dimensional XYZ Cartesian coordinate system. Specifically, the +X direction is an anterior (forward) direction, the −X direction is a posterior (backward) direction, the +Y direction is a superior (upward) direction, the −Y direction is an inferior (downward) direction, the +Z direction is a left direction, and the −Z direction is a right direction. The anteroposterior (front-back) direction, the lateral (left-right) direction, and the vertical (up-down) direction are based on the directions with respect to a user U.

The exerciser 100 can adjust the range of motion of the ankle joint. In the following description, the rotational direction of the ankle joint about the Z axis is referred to as the "plantar/dorsal flexion direction," and the angle of this rotation is referred to as the "plantar/dorsal flexion angle." More specifically, the direction in which the toes of a foot FT are moved downward is referred to as the "plantarflexion direction," and the direction in which the toes of the foot FT are moved upward is defined as the "dorsiflexion direction."

As shown in FIG. 1, the exerciser 100 includes a main body 20, a link 30, a crank 40, and a tilted base 50. A chair 10 is provided behind the exerciser 100. The user U performs a pedaling exercise while sitting on the chair 10. The chair 10 is a seating portion on which the user U sits. The chair 10 may be integral with the exerciser 100, or may be a separate member from the exerciser 100. For example, the chair 10 may be a chair in a facility or home where the user U is located. That is, the user U or the assistant may place the chair 10 behind the exerciser 100.

The chair 10 includes a seat portion 11 that serves as a seating portion and a backrest portion 12. The backrest portion 12 supports the back of the user U sitting on the seat portion 11. That is, the user U can perform a pedaling exercise while leaning against the backrest portion 12. The chair 10 can be replaced or adjusted according to the user U. For example, a user U who does heavier load training can use a chair 10 without the backrest portion 12. Alternatively, the backrest portion 12 may have a reclining mechanism. The angle of the backrest portion 12 may be adjusted by the reclining mechanism.

In the exerciser 100, components attached to the main body 20 are symmetrically. In FIG. 2, in order to distinguish between the right and left components, reference signs for the components on the right side of the main body 20 have the letter "R" at the end, and reference signs for the components on the left side of the main body 20 have the letter "L" at the end. For example, in FIG. 2, the left tilted base 50 is shown as a tilted base 50L, and the right tilted base 50 is shown as a tilted base 50R. Similarly, the left link 30 is shown as a link 30L, the left pedal 31 is shown as a pedal 31L, the right link 30 is shown as a link 30R, and the right pedal 31 is shown as a pedal 31R. Similarly, the left foot FT is shown as a left foot FTL, and the right foot FT is shown as a right foot FTR. In the following description, the letters "R" and "L" will be omitted when the right and left components are not distinguished from each other.

The main body 20 rotatably holds the crank 40. For example, the main body 20 is provided with a rotating shaft 21. The crank 40 is connected to the rotating shaft 21. The crank 40 rotates about the rotating shaft 21. The main body 20 may have a load resistor that applies a load to the rotational motion of the crank 40. The main body 20 may have a gear etc. that can change the load.

The main body 20 is placed on an installation base 15. The installation base 15 is placed on the floor surface. For example, the front (anterior) part of the main body 20 is located on the installation base 15, and the back (posterior) part of the main body 20 is located on the floor surface. The installation angle of the main body 20 can be changed by changing the height, position, etc. of the installation base 15. For example, the main body 20 is placed horizontally by removing the installation base 15. The installation angle of the main body 20 is made steep by raising the installation base 15. The posture of the user U during training is thus changed by changing the height of the installation base 15 or removing the installation base 15. The user U's joint range of motion by training can thus be adjusted.

The distance between the main body 20 and the chair 10 in the anteroposterior direction may be changed according to the user U. For example, the user U can place the chair 10 near the main body 20. In this case, the user U performs a pedaling exercise with his or her knee joints etc. relatively flexed. For example, the user U can place the chair 10 far from the main body 20. In this case, the user U trains with his or her knee joints etc. relatively extended. The posture of the user U during training is thus changed by changing the distance between the main body 20 and the chair 10 in the X direction. The user U's joint range of motion by training can thus be adjusted.

The link 30 includes a pedal 31 and a sliding wheel 35. The crank 40 is connected to the front (anterior) end of the link 30, and the sliding wheel 35 is connected to the back (posterior) end of the link 30. The crank 40 and the link 30 are rotatably connected to each other. For example, the link 30 is attached to the crank 40 via a bearing etc. The pedal 31 is attached to an intermediate position on the link 30. The pedal 31 is a step (footrest) on which the user U places his or her foot FT. The seated user U places his or her foot FT on the pedal 31.

The sliding wheel 35 is attached to the link 30 via a rotating shaft (axle). That is, the link 30 rotatably holds the sliding wheel 35. The sliding wheel 35 is a sliding member that slides on a tilted surface of the tilted base 50.

The user U performs a pedaling exercise with his or her foot FT on the pedal 31. That is, the user U moves his or her knee joint, hip joint, and ankle joint so as to step on the pedal 31. As a result, the crank 40 rotates about the rotating shaft 21. The angle between the link 30 and the crank 40 changes according to the rotation of the crank 40. That is, the relative angle of the link 30 with respect to the crank 40 changes according to the rotation angle of the crank 40 (also referred to as the "crank angle"). The sliding wheel 35 moves in the anteroposterior direction in contact with the tilted surface. The crank 40 and the link 30 therefore rotate according to the pedaling motion so that the pedal 31 follows an elliptical trajectory.

The pedal 31, the sliding wheel 35, the link 30, the crank 40, and the tilted base 50 are provided for each of the right and left feet FT of the user U. That is, the pedal 31, the sliding wheel 35, the link 30, the crank 40, and the tilted base 50 are provided on the right and left sides of the main body 20. The pedal 31R, the sliding wheel 35R, the link 30R, the tilted base 50R, etc. that are provided on the right side of the main body 20 are for the right foot FTR of the user U. The pedal 31L, the link 30L, the tilted base 50L, etc. provided on the left side of the main body 20 are for the left foot FTL of the user U.

The crank 40 is attached to the rotating shaft 21 of the main body 20 so as to be in antiphase between the right and left feet FT. That is, the rotation angle of the crank 40 for the left foot and the rotation angle of the crank 40 for the right foot are shifted by 180°. The user U performs a pedaling exercise by alternately bending and extending his or her right and left legs.

The sliding wheel 35 is attached to the lower end of the link 30. The sliding wheel 35 has a wheel that slides on the tilted surface of the tilted base 50. The tilted base 50 has a tilted surface that is tilted upward toward the back (posterior). The sliding wheel 35 reciprocates in the X direction (anteroposterior direction) according to the rotational motion of the link 30. As shown in FIG. 2, when the user U is pedaling in such a direction that his or her right leg is extended and his or her left leg is bent, the right sliding wheel 35 moves forward (anteriorly) and the left sliding wheel 35 moves backward (posteriorly). As shown in FIG. 1, when the user U is pedaling in such a direction that his or her left leg is extended and his or her right leg is bent, the left sliding wheel 35 moves forward (anteriorly) and the right sliding wheel 35 moves backward (posteriorly).

The height of the sliding wheel 35 changes along the tilted surface of the tilted base 50. The tilted surface of the tilted base 50 becomes higher toward the back (posterior). That is, the tilted base 50 is an uphill for the sliding wheel 35 moving backward (posteriorly). Therefore, the height of the sliding wheel 35 gradually increases as the sliding wheel 35 moves backward (posteriorly). The height of the sliding wheel 35 gradually decreases as the sliding wheel 35 moves forward (anteriorly). The angle of the link 30 is determined according to the height of the sliding wheel 35.

The angle of the pedal 31 located on the link 30 is limited according to the height of the sliding wheel 35. That is, the pedal 31 rotates in the plantarflexion direction as the height of the sliding wheel 35 increases. The pedal 31 rotates in the dorsiflexion direction as the height of the sliding wheel 35 decreases. Therefore, the range of motion for plantarflexion and dorsiflexion of the ankle joint can be adjusted according to the tilt angle of the tilted base 50. The range of motion for plantarflexion and dorsiflexion of the ankle joint can be adjusted according to the rotation angle of the crank 40.

The user U performs a pedaling exercise with the exerciser 100 for training. That is, the pedaling exercise can place a load on the muscles of the lower limbs and trunk of the user U. The muscles that can be built with the exerciser 100 include erector spinae (PS), rectus abdominis (RA), external abdominal oblique (OEA), hip flexor group (HF), gluteus maximus (GM), rectus femoris (RF), tibialis anterior (TA), soleus (SOL), gastrocnemius (MG), Vastus medialis (VM), and hamstring (MH). The user U or the assistant can specify one or more muscle sites the user U wants to build.

Setting Items

Parameters for various setting items can be set in the exerciser 100. The user U etc. changes the parameter of each setting item, so that the user U can train effectively. By changing the parameter of each setting item of the exerciser 100, the user U can adjust the muscle site that can be built by the pedaling exercise and the amount of load to be placed on the muscle site. This allows effective training. The parameter of each setting item need not necessarily be set by the user U who trains, but may be set by the assistant who assists the user U in the training. The assistant may be, for example, a physical therapist or an occupational therapist.

The setting items of the exerciser 100 include, for example, the rotational speed of the crank 40, the amount of load of the crank 40, and the rotational direction of the crank 40. For example, a heavy load can be placed on muscles by increasing the rotational speed of the crank 40 or increasing the amount of load of the crank 40. The muscle site to which a load is placed can be changed by changing the rotational direction of the crank 40.

Other setting items include settings for changing the geometrical arrangement of the exerciser 100. Such setting items include the distance between the chair 10 and the main body 20 in the anteroposterior direction, the installation angle (tilt angle) of the main body 20, the tilt angle of the pedal 31, the tilt angle of the tilted base 50, and the position of the tilted base 50 in the anteroposterior direction. The range of motion angle of the ankle joint can be changed according to the position of the tilted base 50 in the anteroposterior direction and the tilt angle of the tilted base 50. The ranges of motion angle of the knee joint and the hip joint are also changed by changing the distance between the main body 20 and the chair 10 in the anteroposterior direction, the tilt angle of the main body 20, etc. That is, the posture etc. during training can be changed by changing the parameters of the setting items. The muscle site the user U wants to build and the amount of load to be placed on the muscle site can be adjusted by changing the parameters of such setting items.

Other setting items include with or without the backrest portion 12. For example, a chair 10 with a detachable backrest portion 12 is prepared, and the backrest portion 12 may be removed when the user U is going to do heavy load training. Alternatively, a chair 10 with a backrest portion 12 and a chair 10 with no backrest portion 12 may be prepared, and the chair 10 may be replaced according to the training. As described above, a plurality of chairs 10 may be prepared, and the chair 10 may be replaced according to the training.

Other setting items include items that do not involve adjustment, change, or replacement in the exerciser 100. Such setting items may be, for example, the posture and motion of the user U. Specific examples of such setting items include with or without crossed arms, and with or without arm swinging motion. For example, the user U can change the setting item by selecting either with or without arm swinging motion during a pedaling exercise. Alternatively, the user U can change the parameter by selecting whether to cross arms. In this way, the muscle site to be build can be changed according to the posture or motion of the user U.

Various setting items can be set in the exerciser 100. In other words, an appropriate load can be placed on each muscle site by appropriately setting the parameters of the setting items. That is, a desired load can be placed on each muscle site. For example, a heavy load can be placed on the muscle site the user U etc. wants to mainly build. Alternatively, the load can be reduced or the range of motion angle can be limited for the injured part.

As described above, the setting items include items that can be set as numerical parameters such as speed, angle, and relative position. Alternatively, the setting items include items that can be set in levels such as high, medium, and low levels. The setting items further include items that can be set by with or without equipment and with or without operation. The setting items further include items whose settings can be changed by arrangement of the equipment and replacement of the equipment. The setting items further include items whose settings can be changed by the training posture or training motion of the user. For example, for some setting items, with or without equipment or with or without operation can be used as a parameter.

Figure 3:
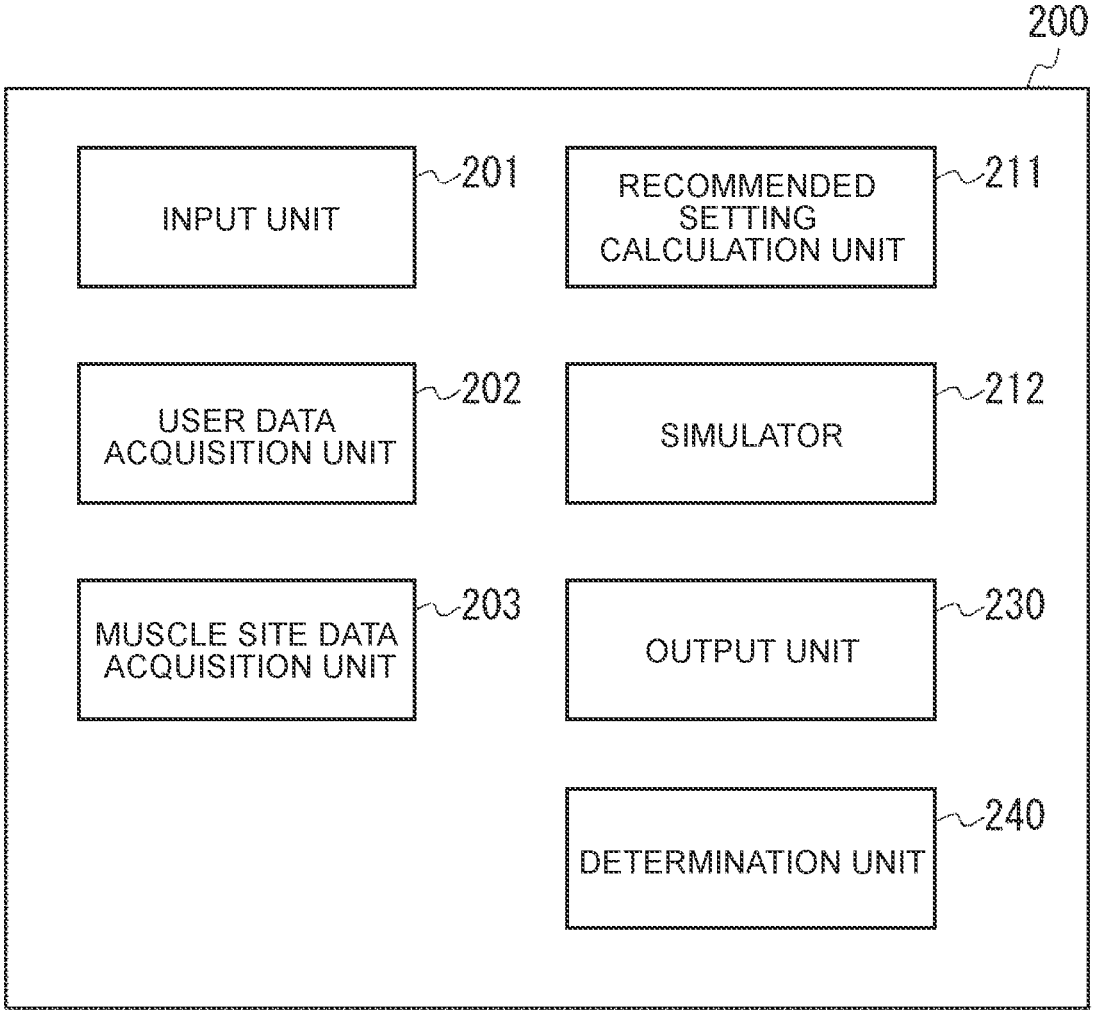
FIG. 3 is a block diagram showing a configuration of a processing system according to an embodiment.

A processing system that can output recommended settings for the above setting items will be described. FIG. 3 is a block diagram illustrating a configuration of a processing system 200. The processing system 200 includes an input unit 201, a user data acquisition unit 202, a muscle site data acquisition unit 203, a recommended setting calculation unit 211, a simulator 212, an output unit 230, and a determination unit 240.

The processing system 200 may be, for example, a personal computer including a processor and a memory. The processing system 200 therefore stores a processing program in advance. The processing system 200 can perform a process, which will be described later, by the processor executing the program.

The input unit 201 includes an input device such as touch panel, keyboard, or mouse. The user U or the assistant (hereinafter collectively referred to as the user U etc.) can enter various kinds of information by operating the input unit 201. Alternatively, the input unit 201 may have a microphone etc. for voice input.

The user data acquisition unit 202 acquires user data on the user U who is going to train. The user data includes physical information of the user U. For example, the user data include the height, weight, lower limb length, upper limb length, trunk length, etc. of the user U. The user data is not limited to the physical features, but may include other features such as age and gender.

For example, the user U etc. enters numerical values such as height by operating the input unit 201. The user data acquisition unit 202 thus acquires the user data of the user U. Alternatively, the user data acquisition unit 202 may read the user data from the memory etc. For example, it is herein assumed that user identifications (user IDs) and user data are linked to each other and stored in the memory etc. The processing system 200 may store a user table in which user data such as height is linked to the user IDs for each user. In this case, when the user U etc. enters the user ID, the user data acquisition unit 202 reads the user data corresponding to the user ID from the memory.

The muscle site data acquisition unit 203 acquires muscle site data indicating the muscle site that the user U wants to build. For example, the user U etc. enters the muscle site the user U wants to build by operating the input unit 201. As described above, the muscle sites include erector spinae (PS), rectus abdominis (RA), external abdominal oblique (OEA), hip flexor group (HF), gluteus maximus (GM), rectus femoris (RF), tibialis anterior (TA), soleus (SOL), gastrocnemius (MG), Vastus medialis (VM), and hamstring (MH). Only the left muscle site or the right muscle site may be entered. For example, if either the left leg or the right leg is injured, the load can be varied between the injured leg and the other leg.

For example, a display displays a list of muscle sites, and the user U etc. selects a muscle site from the list. Alternatively, the muscle site data acquisition unit 203 may identify the muscle site the user U wants to build by asking questions. Specifically, the output unit 230, which will be described later, outputs such questions that identify the muscle site the user U wants to build to the user U. The muscle site data acquisition unit 203 identifies the muscle site the user U wants to build by the user U etc. answering the questions. When the user U etc. wants to build a plurality of muscle sites, the muscle site data acquisition unit 203 may acquire two or more muscle sites as muscle site data. The muscle site data acquisition unit 203 may identify the muscle site the user U etc. wants to build by the user U etc. specifying the muscle sites that the user U etc. does not want to build.

The muscle site data acquisition unit 203 also acquires the amount of load to be placed on the muscle site the user U etc. wants to build. For example, the user U enters the muscle site and the amount of load to be placed on the muscle site by operating the input unit 201. The muscle site data acquisition unit 203 can thus acquire the muscle site data on the muscle site the user U etc. wants to build and the amount of load to be placed on the muscle site. The amount of load may be a numerical value such as percentage (%), or may be set in levels such as high and low levels. The amount of load may be set in three or more levels such as high, medium, and low levels.

The recommended setting calculation unit 211 calculates recommended settings for the setting items based on the user data and the muscle site data. The recommended setting calculation unit 211 calculates the recommended settings by referring to the past measurement results and the simulation results. For example, a change in load placed on the muscle site can be obtained by measuring the myoelectric potential of the user U during training. That is, the myoelectric potential is measured in advance by changing the parameter of each setting item. The myoelectric potential corresponds to the muscle activity or the degree of muscle firing. The setting item that is highly correlated with the muscle site can thus be obtained in advance. For example, a table etc. in which the setting items are linked to the muscle sites to be built for each parameter of the setting items are linked is created in advance. The recommended setting calculation unit 211 can present an appropriate recommended setting for each setting item by referring to the table etc.

The simulator 212 calculates muscle activities using, for example, a computer. The simulator 212 calculates muscle activities using a human body computer model (e.g., a human body model such as human body finite element model). That is, the simulator 212 calculates a change in muscle activity of each muscle caused by the pedaling exercise. The simulator 212 calculates a change in muscle activity with time during one rotation time. For example, by receiving physique data such as height and lengths of lower limb joints, the simulator 212 creates a human body model with that physique and performs a simulation.

The simulator 212 can perform simulations for human body models with various physiques by using a human body computer model such as human body finite element model. A plurality of simulation results can be obtained by changing the simulation conditions of the simulator 212. As described above, the simulation conditions include physique data such as height and lengths of lower limb joints. The simulation conditions further include the parameters of the setting items of the exerciser 100.

The simulator 212 performs a plurality of simulations for a human body model with one physique by changing the parameters of the setting items. A plurality of simulation results can thus be obtained for a human body model with a physique similar to the user data. For the human body model with a physique similar to the user data, simulation results are calculated by changing the parameters of the setting items. For the human body model with a physique similar to the user data, a change in muscle activity caused by changing the parameters of the setting items can thus be obtained. The muscle activity corresponds to the load that is placed on the muscle site. The simulator 212 outputs the simulation results of the load that is placed on each muscle site.

By comparing the simulation results of the simulator 212, the difference in muscle activity can be evaluated for each muscle. For example, the simulator 212 performs simulations by changing the rotational direction and rotational speed of the crank 40. The difference in muscle activity due to the rotation direction and rotation speed of the crank 40 can thus be evaluated for each muscle. By comparing the simulation results with arm swinging motion with the simulation results without arm swinging motion, the difference in muscle activity between with and without arm swinging motion can be evaluated for each muscle. The simulator 212 performs simulations by changing the installation angle of the main body 20, the tilt angle of the tilt base 50, etc. The difference in muscle activity caused by changing the geometrical arrangement of the exerciser 100 can thus be evaluated.

The recommended setting calculation unit 211 may calculate recommended settings by referring to the simulation results of the simulator 212. That is, the recommended setting calculation unit 211 compares the simulation results of the human body model with a physique similar to the user data. The recommended setting calculation unit 211 then calculates the setting item that is highly correlated with the muscle site the user U wants to build. For the setting item that is highly correlated with the muscle site, the recommended setting calculation unit 211 may calculate an optimal set value etc. in order to increase the load. For the setting item that is highly correlated with the muscle site, a parameter for increasing the load or a parameter for reducing the load can be obtained for each muscle site.

The recommended setting calculation unit 211 can also obtain an optimal numerical value (position, angle, etc.) of the setting item. For example, for the distance between the main body 20 and the chair 10 in the anteroposterior direction, the recommended setting calculation unit 211 can calculate an optimal parameter for the physique of the user U. The recommended setting calculation unit 211 may calculate an optimal value for the tilt angle of the main body 20 and the tilt angle of the tilted base 50. The recommended setting calculation unit 211 need not necessarily calculate a single optimal value, but may calculate a predetermined range (optimal range) as a recommended setting.

The output unit 230 outputs the recommended settings calculated by the recommended setting calculation unit 211. The output unit 230 includes a display etc. The output unit 230 displays the recommended settings to the user U. Alternatively, the output unit 230 may have a speaker for outputting the recommended settings by voice.

The display of the output unit 230 may display a screen for entering the user data and the muscle site data. For example, a touch panel display displays a keyboard or pull-down menu for entering numerical values. Alternatively, the display may display questions for setting the muscle site and the amount of load. Alternatively, the output unit 230 may output questions for setting the muscle site and the amount of load by voice from the speaker. In this case, the user U etc. may input the muscle site the user U wants to build and the amount of load to be placed on the muscle site by voice using a microphone. The display output, the touch panel input, the voice input, and the voice output can be combined as appropriate.

The determination unit 240 determines whether the exerciser 100 is operating with the recommended settings calculated by the recommended setting calculation unit 211. When the exerciser 100 is not operating with the recommended settings, the output unit 230 notifies the user U etc. For example, the output unit 230 may output a warning message, a warning sound, etc. This can facilitate the operation with the recommended settings.

For example, the determination unit 240 may include sensors that can detect the position, angle, shape, etc. of equipment. The determination unit 240 determines whether the geometric arrangement of various pieces of equipment matches the recommended settings, based on the detection results of the sensors. For example, the determination unit 240 may detect the presence or absence of the equipment by a contact sensor etc. Alternatively, the determination unit 240 may detect, for example, the presence or absence of the equipment and the arrangement and tilt angle of the equipment by analyzing an image of the exerciser 100 that is captured by a camera. The determination unit 240 makes a determination by comparing the results detected by various sensors with the recommended settings.

The processing system 200 may be configured by a single device or may have a distributed configuration of a plurality of devices. For example, the processing system 200 may be a device that is physically different from a device including the recommended setting calculation unit 211 and the simulator 212 and a device including the input unit 201 and the output unit 230. The recommended setting calculation unit 211 and the simulator 212 may be physically different devices. The recommended setting calculation unit 211 need only be able to refer to the simulation results of the simulator 212.

Hereinafter, the correlation between the muscle sites and the setting items will be described. When the setting item is with or without the backrest portion 12, the load on PS, HF, RA, OEA, and RF is increased by changing from "with backrest" to "without backrest." Particularly, the load on RA, OEA, and RF is significantly increased by changing from "with backrest" to "without backrest." Therefore, when PS, HF, RA, OEA, or RF is the muscle site the user U wants to build, the recommended setting calculation unit 211 calculates "without backrest" as a recommended setting. In other words, when none of PS, HF, RA, OEA, and RF is the muscle site the user U wants to build, the recommended setting calculation unit 211 calculates "with backrest" as a recommended setting.

When the setting item is with or without arm swinging motion of the user U, the load on PS, RA, HF, RF, and OEA is increased by changing from "without arm swinging motion" to "with arm swinging motion." Particularly, the load on OEA is significantly increased by changing from "without arm swinging motion" to "with arm swinging motion." Therefore, when PS, RA, HF, RF, or OEA is the muscle site the user U wants to build, the recommended setting calculation unit 211 calculates "with arm swinging motion" as a recommended setting. In other words, when none of PS, RA, HF, RF, and OEA is the muscle site the user U wants to build, the recommended setting calculation unit 211 calculates "without arm swinging motion" as a recommended setting.

When the setting item is with or without crossed arms of the user U, the load on OEA and RA is increased by changing from "without crossed arms" to "with crossed arms." Therefore, when OEA or RA is the muscle site the user U wants to build, the recommended setting calculation unit 211 calculates "with crossed arms" as a recommended setting. In other words, when neither OEA nor RA is the muscle site the user U wants to build, the recommended setting calculation unit 211 calculates "without crossed arms" as a recommended setting.

Next, an example in which the setting item is the rotational direction of the crank 40 will be described. The rotational direction of the crank 40 includes forward rotation and reverse rotation. The forward rotation of the crank 40 is rotation in the clockwise direction when the user U and the main body 20 are viewed from the right side of the user U. The reverse rotation of the crank 40 is rotation in the counterclockwise direction when the user U and the main body 20 are viewed from the right side of the user U.

The user U can also select between a pedaling exercise with both legs and a pedaling exercise with one leg. By attaching a belt etc. to the pedal 31, the user U can perform a pedaling exercise with only one leg. That is, by fixing one leg of the user U to the pedal 31 with a belt or strap, the user U can rotate the crank 40 with only one leg. Therefore, there are four settings for the rotation direction of the crank 40: forward rotation on both sides, reverse rotation on both sides, forward rotation on one side, and reverse rotation on one side. In forward rotation on both sides and reverse rotation on both sides, the user U rotates the crank 40 with both legs. In forward rotation on one side and reverse rotation on one side, the user U rotates the crank 40 with either the right or left leg.

The load on SOL, RF, HF, and VM is increased by changing the rotational direction of the crank 40 from forward rotation on both sides to reverse rotation on both sides. Particularly, the load on VM is significantly increased by changing the rotational direction of the crank 40 to reverse rotation on both sides. The load on TA, MG, and MH is reduced by changing the rotational direction of the crank 40 to reverse rotation on both sides. Therefore, when SOL, RF, HF, or VM is the muscle site the user U wants to build, the recommended setting calculation unit 211 calculates "reverse rotation on both sides" as a recommended setting. When TA, MG, or MH is the muscle site the user U wants to build, the recommended setting calculation unit 211 calculates "forward rotation on both sides" as a recommended setting.

The load on TA, VM, RF, and MH is increased by changing the rotational direction of the crank 40 from forward rotation on both sides to forward rotation on one side. Particularly, the load on RF and TA is significantly increased by changing the rotational direction of the crank 40 from forward rotation on both sides to forward rotation on one side. Therefore, when TA, VM, RF, or MH on one side is the muscle site the user U wants to build, the recommended setting calculation unit 211 calculates "forward rotation on one side" as a recommended setting. That is, when the left TA, left VM, left RF, or left MH is the muscle site the user U wants to build, the recommended setting calculation unit 211 calculates "forward rotation on left side" as a recommended setting. In this case, the user U performs a pedaling exercise with his or her left foot fixed to the pedal 31L with a belt etc.

The load on RF, TA, and MH is increased by changing the rotational direction of the crank 40 from reverse rotation on both sides to forward rotation on one side. Particularly, the load on TA is significantly increased by changing the rotational direction of the crank 40 from reverse rotation on both sides to forward rotation on one side. Therefore, when RF, MH, or TA on one side is the muscle site the user U wants to build, the recommended setting calculation unit 211 calculates "forward rotation on one side" as a recommended setting. That is, when the left RF, left MH, or left TA is the muscle site the user U wants to build, the recommended setting calculation unit 211 calculates "forward rotation on left side" as a recommended setting.

As described above, when the user U wants to mainly build either the left or right muscle site, the recommended setting calculation unit 211 calculates "forward rotation on one side" or "reverse rotation on one side" using the leg on the same side as the muscle site as a recommended setting.

Next, the rotational speed of the crank 40 as a setting item will be described. It is herein assumed that low-speed rotation is 30 rotations per minute, and high-speed rotation is 70 rotations per minute. The load on TA, SOL, MG, RF, VM, and MH is increased by changing the rotational speed of the crank 40 from low-speed rotation to high-speed rotation. When TA, SOL, MG, RF, VM, or MH is the muscle site the user U wants to build, the recommended setting calculation unit 211 calculates "forward rotation on one side" as a recommended setting. The higher the rotational speed, the heavier the load. The rotational speed of the crank 40 may be set in two levels such as low-speed rotation and high-speed rotation, or may be set in three or more levels. Alternatively, the user U may enter a numerical value of an actual rotational speed (rpm).

A pitch sound that is generated during a pedaling exercise will be described. A pitch sound is a sound that is generated in a certain repeating cycle. The user U can maintain a constant rotational speed by performing a pedaling exercise while listening to the pitch sound. That is, the load that is placed on a muscle can be adjusted according to the presence or absence of the pitch sound and its cycle. The load on SOL, VM, and MH can be increased by changing "without pitch sound" to "with pitch sound."

Therefore, when SOL, VM, or MH is the muscle site the user U wants to build, the recommended setting calculation unit 211 calculates "with pitch sound" as a recommended setting. The rotational drive speed can be controlled by the pitch sound. The pitch sound can not only make the rotational driving smooth, but also facilitate the activity of the lower limb extensor group. Therefore, this configuration is applicable to patients for the purpose of facilitating the lower limb extensor group.

Next, the setting item for the knee extension angle of the knee joint will be described. It is herein assumed that the knee extension angle when the knee joint is not flexed, namely when the knee is fully extended, is 0 degrees, and the knee extension angle increases as the knee joint is flexed. For example, the knee extension angle is 0 degrees when the upper leg and the lower leg are parallel, and the knee extension angle is 90 degrees when the upper leg and the lower leg form a right angle.

The maximum knee extension angle means the angle when the knee joint is extended to the maximum extent possible while the crank 40 is rotated 360 degrees about the rotating shaft 21. The myoelectric potential is measured when the maximum knee extension angle is 0 degrees, 30 degrees, and 60 degrees. That is, the measurement is performed at each of the maximum knee extension angles of 0 degrees, 30 degrees, and 60 degrees. Hereinafter, a change in load obtained from the results of the three measurements at different maximum knee extension angles will be described.

When the maximum knee extension angle is 0 degrees, the knee joint is fully extended. Therefore, the range of motion of the knee joint is maximized. The range of motion of the knee joint decreases in the order of the maximum knee extension angles of 0 degrees, 30 degrees, and 60 degrees. That is, the larger the maximum knee extension angle, the less the knee needs to be extended to perform a pedaling exercise, and therefore the lighter the load.

An increase in load that is caused by changing the maximum knee extension angle from the flexion side to the extension side will be described. That is, the range of the load resulting from increasing the range of motion of the knee joint to the extension side by making the maximum knee extension angle close to 0 degrees will be described. The load on TA, SOL, MG, RF, VA, and MH is increased by making the maximum knee extension angle close to 0 degrees. Therefore, when TA, SOL, MG, RF, VA, or MH is the muscle site the user U wants to build, the recommended setting calculation unit 211 calculates such a recommended setting that makes the maximum knee extension angle close to 0 degrees.

The maximum knee extension angle can be adjusted based on such a setting item that changes the pedaling exercise posture of the user U. That is, the maximum knee extension angle can be increased to the extension side (made close to 0°) by changing such a setting item that changes the geometrical arrangement of the components. The maximum knee extension angle can be adjusted by changing, for example, the distance between the chair 10 and the main body 20 in the anteroposterior direction or the tilt angle of the main body 20.

Pedaling Posture

Next, the setting items related to the geometric arrangement for changing the pedaling posture of the user U will be described. FIGS. 4A to 7B are side views showing the postures of the user U. Some configurations are not illustrated in FIGS. 4A to 7B. For example, in FIG. 4A, only the pedal 31 and the link 30 of the exerciser 100 are illustrated, and illustration of the configurations such as the main body 20, the installation base 15, and the crank 40 is omitted as appropriate.

Figure 4A:
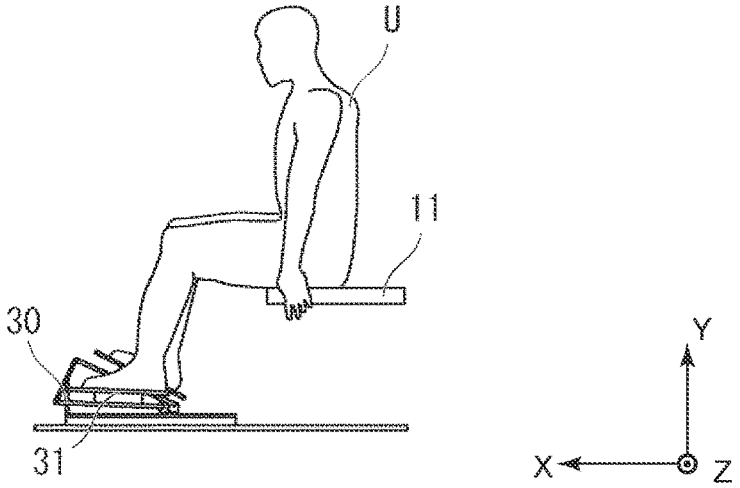
FIG. 4A shows the user's posture when the distance between a chair and a main body in an anteroposterior direction is normal.
Figure 4B:
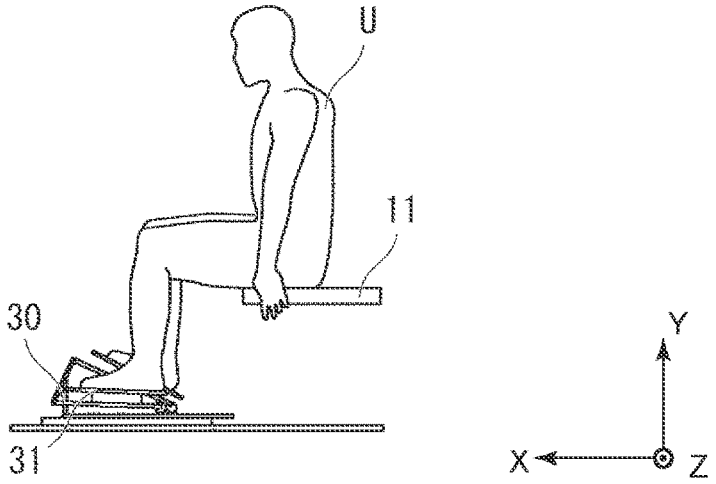
FIG. 4B shows the user's posture when the distance between the chair and the main body in the anteroposterior direction is small.
Figure 4C:
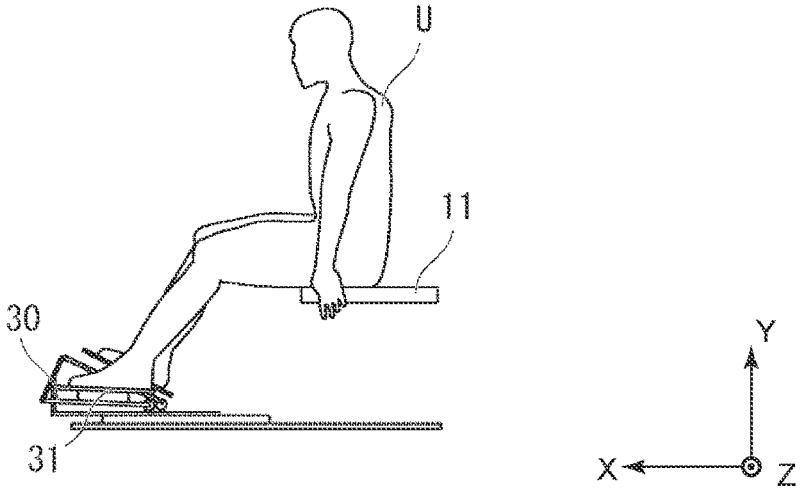
FIG. 4C shows the user's posture when the distance between the chair and the main body in the anteroposterior direction is large.

FIGS. 4A to 4C show the postures with different installation distances between the main body 20 and the chair 10 in the anteroposterior direction. FIG. 4A shows the posture when the installation distance of the chair 10 to the main body 20 in the X direction is normal. FIG. 4B shows the posture when the installation distance of the chair 10 to the main body 20 in the X direction is small. FIG. 4C shows the posture when the installation distance of the chair 10 to the main body 20 in the X direction is large. When the setting item is the installation distance between the main body 20 and the chair 10, the parameter of this setting item is classified into three levels: large distance, normal distance, and small distance. That is, for the setting item regarding the installation distance between the main body 20 and the chair 10, the recommended setting calculation unit 211 recommends one of large distance, normal distance, and small distance as a recommended setting.

The installation distance (distance in the anteroposterior direction) between the main body 20 and the chair 10 is changed by changing the position of either or both of the chair 10 and the main body 20. The knee extension angle can be increased to the extension side by moving the chair 10 farther away from the main body 20. The ranges of motion of the knee joint, the ankle joint, etc. can be adjusted according to the distance between the main body 20 and the chair 10. The muscle site that can be built by training and the amount of the load to be placed on the muscle site can thus be changed.

Figure 5A:
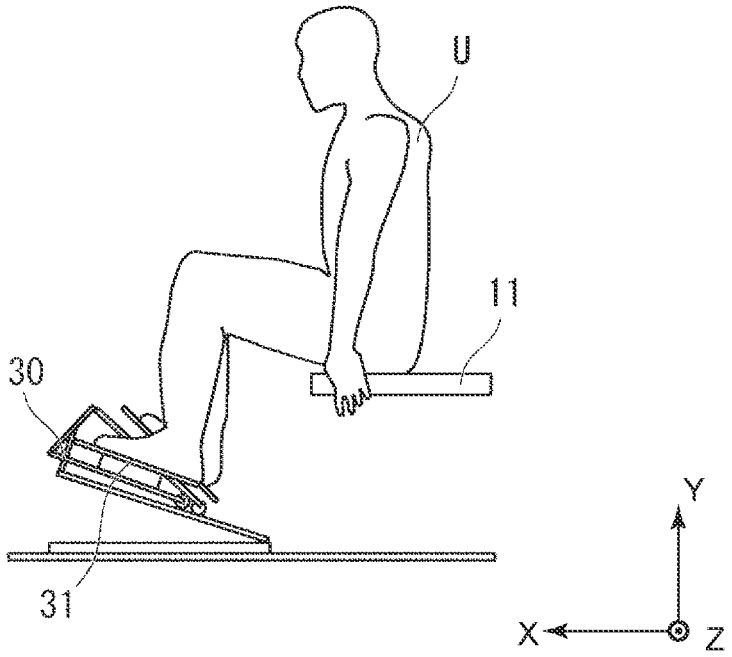
FIG. 5A shows the user's posture when the main body is tilted and the distance between the chair and the main body in the anteroposterior direction is normal.
Figure 5B:
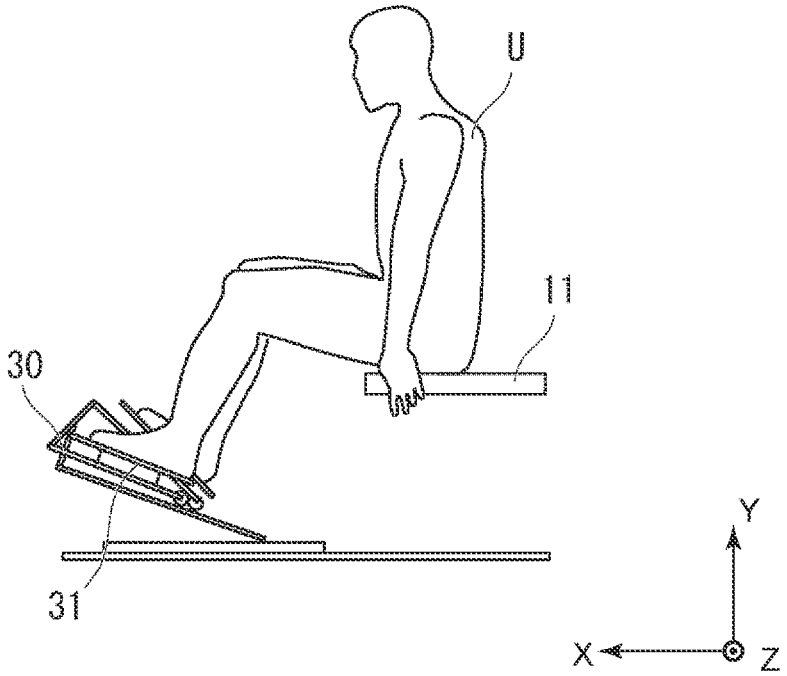
FIG. 5B shows the user's posture when the main body is tilted and the distance between the chair and the main body in the anteroposterior direction is large.

FIGS. 5A and 5B show the user's postures when the installation angle of the main body 20 is tilted. FIG. 5A shows the posture when the distance of the chair 10 to the main body 20 is normal. FIG. 5B shows the posture when the distance of the chair 10 to the main body 20 is large. For example, the installation angle (tilt angle) of the main body 20 can be changed by attaching or detaching the installation base 15 shown in FIGS. 1 and 2. In FIGS. 5A and 5B, the main body 20 is placed on the installation base 15 so that the front (anterior) part of the main body 20 is located higher than in FIGS. 4A to 4C. That is, the main body 20 is tilted downward toward the back (posterior) by placing the main body 20 on the installation base 15. The ranges of motion of the knee joint, the ankle joint, etc. can be adjusted according to the installation angle of the main body 20. The ankle joint can be flexed in the dorsiflexion direction by increasing the tilt angle of the main body 20.

Therefore, the posture of the user U changes according to the installation angle of the main body 20. The main body 20 is located horizontally in FIGS. 4A to 4C, and the main body 20 is located in a tilted manner in FIGS. 5A to 5B. The ranges of motion of the knee joint, the ankle joint, etc. can be adjusted according to the presence or absence of the installation base 15. When the setting item is the installation angle of the main body 20, the parameter of this setting item is classified into two levels, "main body tilt" and "no main body tilt." That is, for the setting item regarding the installation angle of the main body 20, the recommended setting calculation unit 211 recommends either "main body tilt" or "no main body tilt" as a recommended setting. The muscle site that can be built by training and the amount of the load to be placed on the muscle site can thus be changed.

The angles of the knee joint, the ankle joint, etc. also change according to the installation angle of the main body 20. Therefore, the ranges of motion of the knee joint, the ankle joint, etc. can be finely adjusted by finely dividing the installation angle of the main body 20. That is, the recommended setting calculation unit 211 recommends a numerical value or numerical range of the tilt angle of the main body 20 as a recommended setting. Alternatively, the recommended setting calculation unit 211 may recommend a numerical value or numerical range of the height or installation position of the main body 20 as a recommended setting. The posture and load can thus be set more finely. The muscle site that can be built by training and the amount of load to be placed on the muscle site can be changed by the tilt angle of the main body 20 and the installation base 15.

Figure 6A:
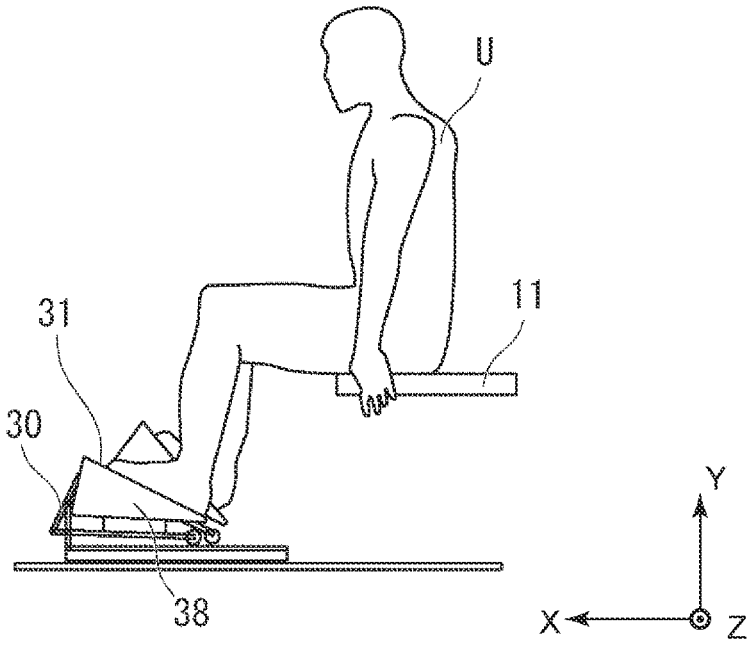
FIG. 6A shows the user's posture when a pedal is tilted in a dorsiflexion direction and the distance between the chair and the main body in the anteroposterior direction is normal.
Figure 6B:
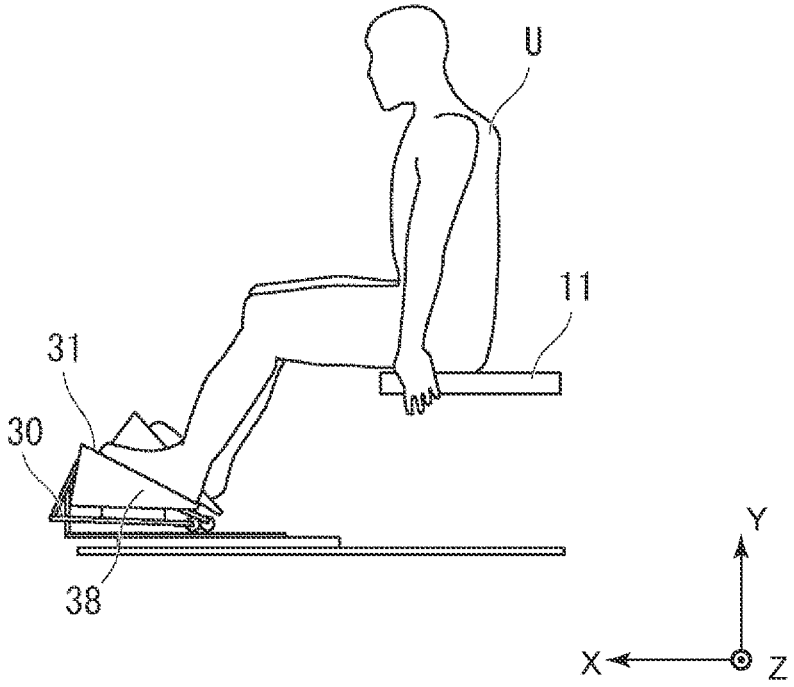
FIG. 6B shows the user's posture when the pedal is tilted in the dorsiflexion direction and the distance between the chair and the main body in the anteroposterior direction is large.

FIGS. 6A and 6B show the user's postures when the pedal 31 is tilted. In FIGS. 6A and 6B, an adjusting member 38 for tilting the pedal 31 is attached to the pedal 31. For example, the angles of the knee joint, the ankle joint, etc. can be adjusted by placing the adjusting member 38 between the pedal 31 and the link 30 shown in FIGS. 1 and 2. FIG. 6A shows the posture when the distance of the chair 10 to the main body 20 is normal. FIG. 6B shows the posture when the distance of the chair 10 to the main body 20 is large.

For example, the adjusting member 38 is a wedge-shaped block. The pedal 31 can be tilted in the dorsiflexion direction by inserting the adjusting member 38 between the pedal 31 and the link 30. The angle of the ankle joint etc. changes according to the installation angle of the pedal 31. Since the ankle joint angle changes according to the installation angle of the pedal 31, the ankle joint can be flexed in the dorsiflexion direction.

In the configurations of FIGS. 6A and 6B, the ankle joint can be flexed in the dorsiflexion direction more than in the configurations of FIGS. 4A to 4C. In FIGS. 4A to 4C, the pedal 31 is not tilted in the dorsiflexion direction because the adjusting member 38 is not placed. In FIGS. 6A and 6B, the pedal 31 is tilted in the dorsiflexion direction as compared to FIGS. 4A to 4C because the adjusting member 38 is placed. Therefore, the posture of the user U changes according to the installation angle of the pedal 31.

The ranges of motion of the knee joint, ankle joint, etc. can be adjusted according to the presence or absence of the adjusting member 38. The ankle joint angle need not necessarily be adjusted by attaching or detaching the adjusting member 38, and may be adjusted by changing the shape of the pedal 31. For example, a wedge-shaped pedal 31 can be used.

When the setting item is the installation angle of the pedal 31, the parameter of the setting item is classified into two levels, "pedal tilt" and "no pedal tilt." That is, for the installation angle of the pedal 31, the recommended setting calculation unit 211 recommends either "pedal tilt" or "no pedal tilt" as a recommended setting. The muscle site that can be built by training and the amount of the load to be placed on the muscle site can thus be changed.

Moreover, preparing a plurality of adjusting members 38 with different angles allows fine adjustment of the ankle joint angle. The assistant etc. may replace the adjusting member 38 according to the user U. For example, when the assistant replaces the adjusting member 38 with another adjusting member 38 with a larger wedge angle, the ankle joint can be flexed more in the dorsiflexion direction. The adjusting member 38 may be installed so as to flex the ankle joint in the plantarflexion direction. For example, the wedge-shaped adjusting member 38 may be inserted in the opposite direction. The adjusting member 38 is not limited to the wedge shape, but may have various shapes.

The tilt angle of the pedal 31 can therefore be finely adjusted by, for example, replacing the adjusting member 38. The range of motion of the ankle joint can be more finely adjusted according to the shape, angle, position, etc. of the adjusting member 38. The angles of the knee joint, the ankle joint, etc. change according to the tilt angle of the pedal 31. Therefore, the ranges of motion of the knee joint, the ankle joint, etc. can be finely adjusted by finely dividing the installation angle of the pedal 31. That is, the recommended setting calculation unit 211 recommends a numerical value or numerical range of the tilt angle of the pedal 31 as a recommended setting. Alternatively, the recommended setting calculation unit 211 may recommend a numerical value or numerical range of the height or angle of the adjusting member 38 as a recommended setting. The posture and load can thus be set more finely. The muscle site that can be built by training and the amount of load to be placed on the muscle site can be changed by the tilt angle of the pedal 31 and the adjusting member 38.

Figure 7A:
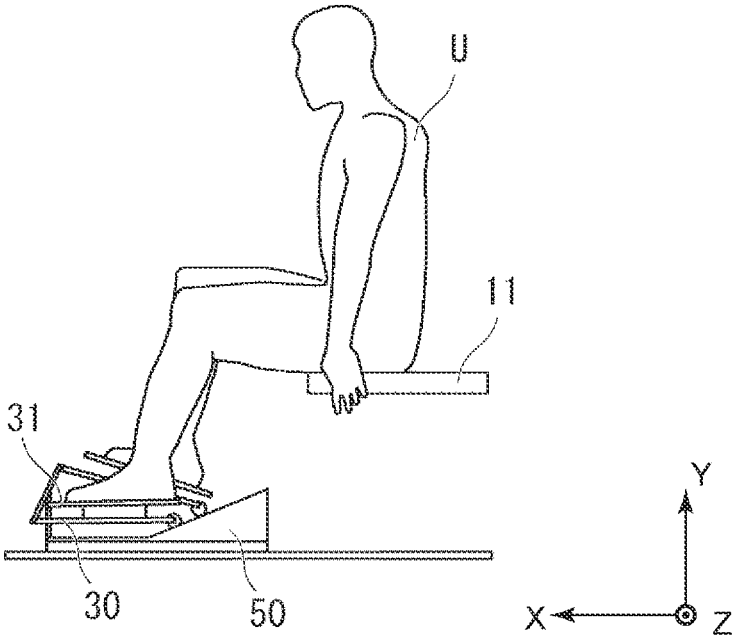
FIG. 7A shows the user's posture when a tilted base is placed and the distance between the chair and the main body in the anteroposterior direction is normal.
Figure 7B:
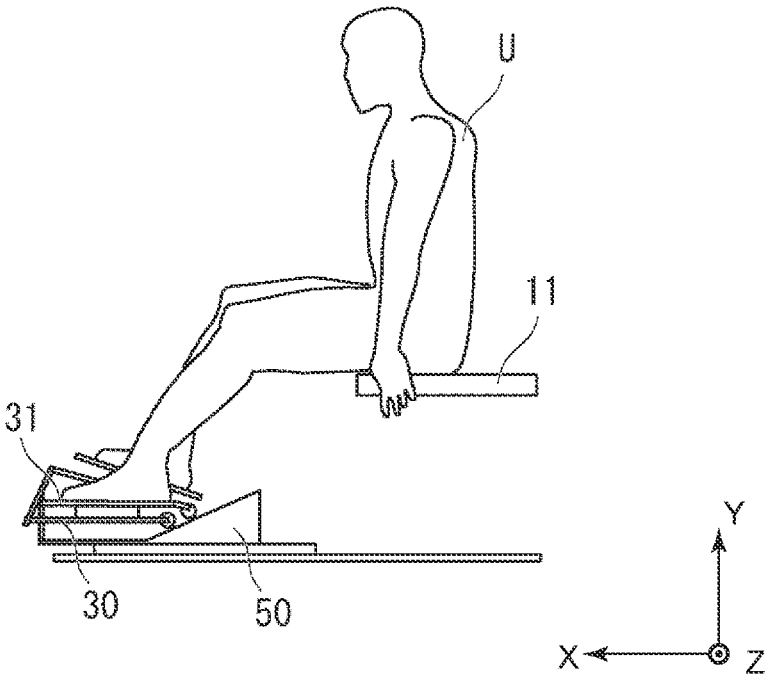
FIG. 7B shows the user's posture when the tilted base is placed and the distance between the chair and the main body in the anteroposterior direction is large.

FIGS. 7A and 7B illustrate the user's postures when the tilted base 50 is placed. FIG. 7A illustrates the posture when the distance of the chair 10 to the main body 20 is normal. FIG. 7B illustrates the posture when the distance of the chair 10 to the main body 20 is large. For example, the tilted base 50 shown in FIGS. 1 and 2 is attached. When there is the tilted base 50, the ankle joint can be flexed in the plantarflexion direction more than when there is no tilted base 50.

The user's posture changes according to the presence or absence of the tilted base 50. The ranges of motion of the knee joint, ankle joint, etc. can be adjusted according to the presence or absence of the tilted base 50. When the setting item is with or without the tilted base 50, the parameter of the setting item is classified into two levels, "with tilted base" and "without tilted base." That is, for this setting item regarding the tilted base 50, the recommended setting calculation unit 211 recommends either "with tilted base" or "without tilted base" as a recommended setting. The muscle site that can be built by training and the amount of the load to be placed on the muscle site can thus be changed.

The user's posture also changes according to the tilt angle of the tilted base 50 and the position of the tilted base 50 in the anteroposterior direction. The tilt angle of the tilted base 50 can be changed by replacing the tilted base 50 with another tilted base 50 with a different tilt angle. The user U can thus perform a pedaling exercise with the ankle joint in an appropriate range of motion. Alternatively, the range of motion of the ankle joint can be set to an appropriate range by changing the position of the tilted base 50 in the anteroposterior direction. The ankle joint angle can thus be more finely adjusted by changing the geometrical position of the tilted base 50. For the setting item regarding the tilted base 50, the recommended setting calculation unit 211 may calculate a numerical value or numerical range of the tilt angle or attachment position (X coordinate) of the tilted base 50 as a recommended setting. The muscle site that can be built by training and the amount of the load to be placed on the muscle site can thus be changed.

Parameter Setting Examples

Figure 8:
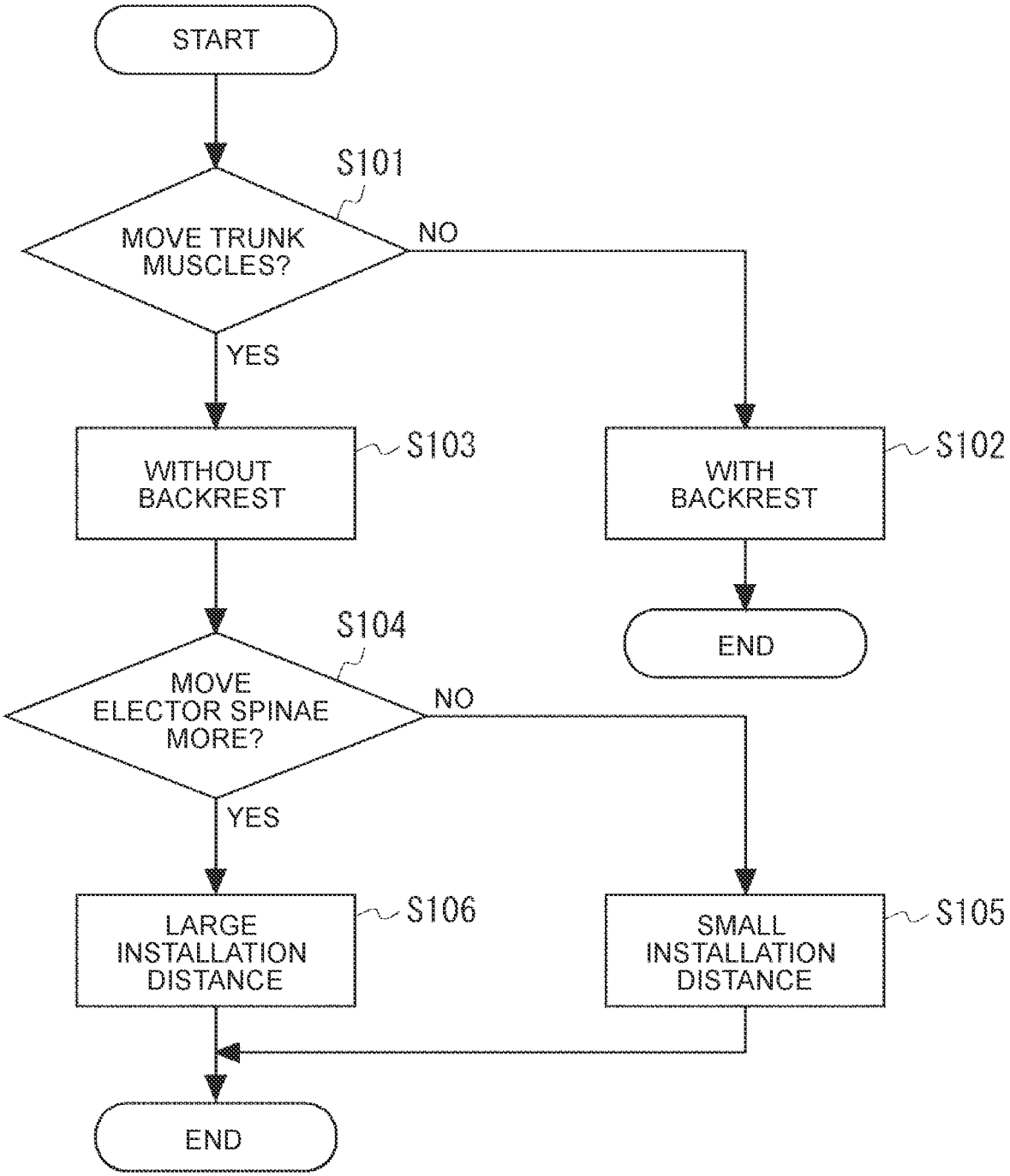
FIG. 8 is a flowchart showing a process of calculating recommended settings of setting items.
Figure 9:
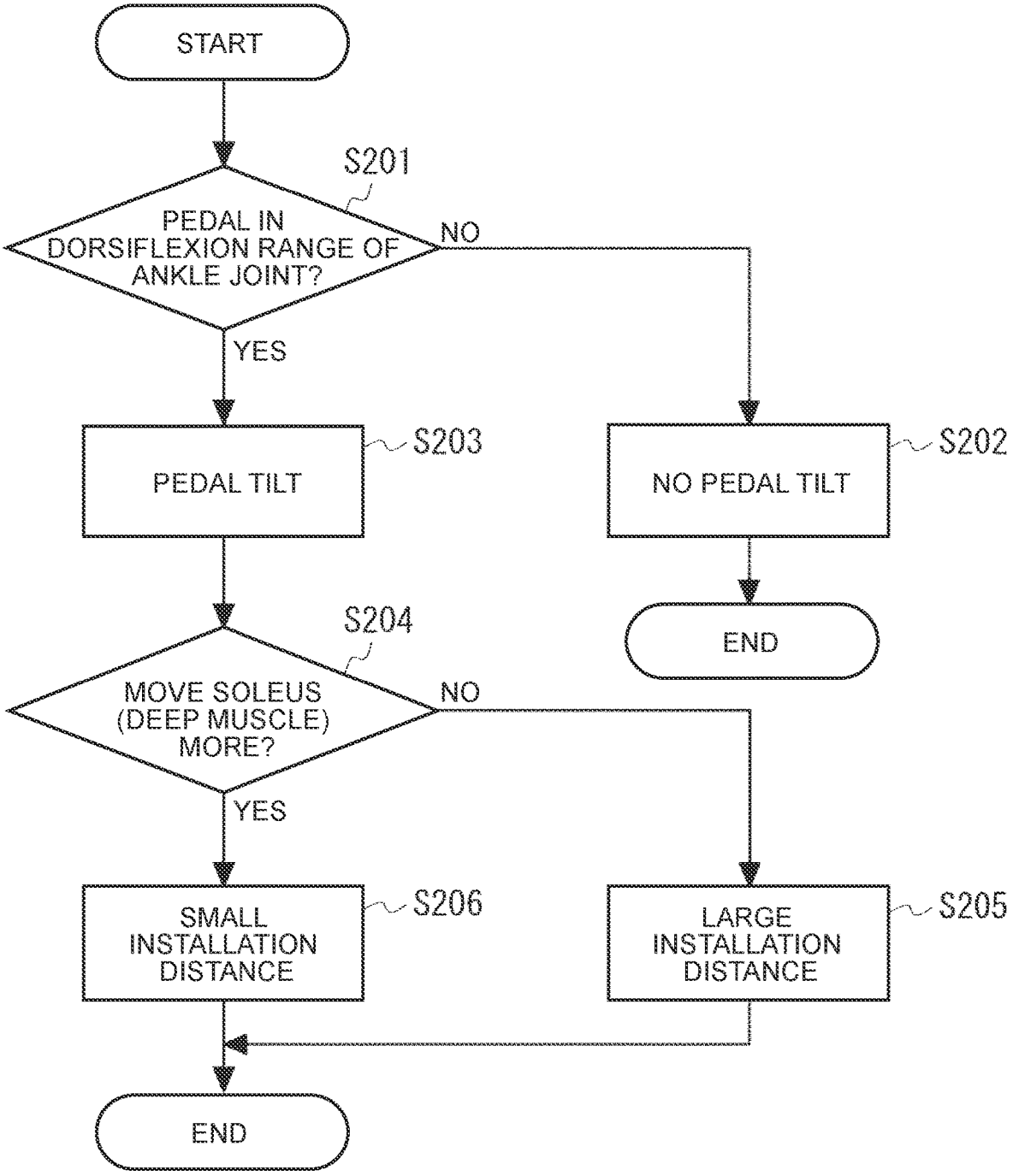
FIG. 9 is a flowchart showing a process of calculating recommended settings of setting items.
Figure 10:
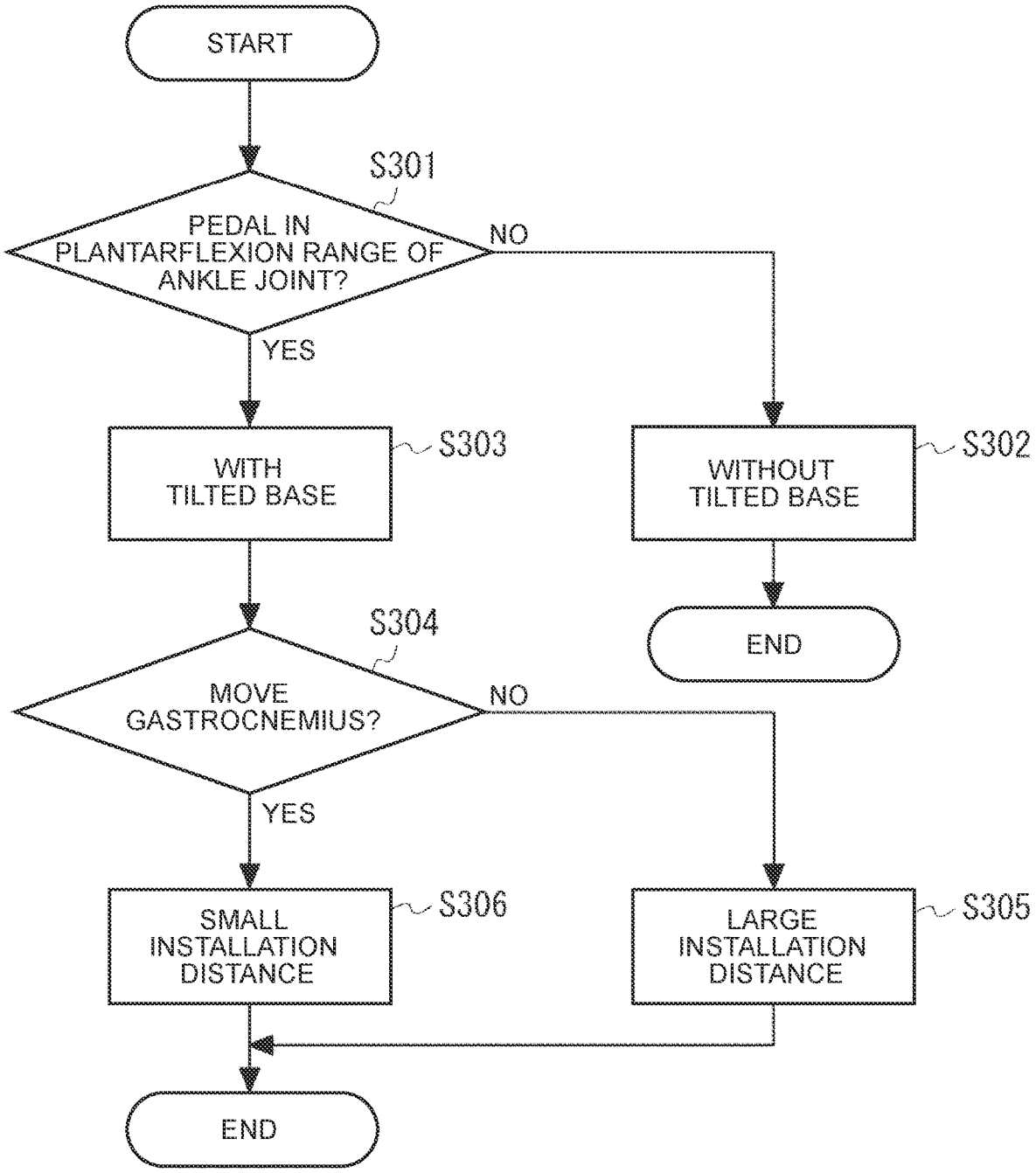
FIG. 10 is a flowchart showing a process of calculating recommended settings of setting items.

Examples of a process of setting recommended settings will be described with reference to FIGS. 8 to 10. FIGS. 8 to 10 are flowcharts each illustrating a process of setting recommended settings.

FIG. 8 shows a process of calculating recommended settings for the following setting items: with or without the backrest, and the installation distance between the main body 20 and the chair 10. As shown in FIG. 8, the processing system 200 asks the user U etc. whether to move the trunk muscles (S101). For example, the display of the output unit 230 displays a message such as "Move trunk muscles?" When the user U etc. enters that the user U does not move the trunk muscles (NO in S101), the recommended setting calculation unit 211 recommends "with backrest" (S102). The output unit 230 outputs "with backrest" as a recommended setting. The user U sits on the chair 10 with the backrest portion 12 and performs a pedaling exercise. In this case, the installation distance between the main body 20 and the chair 10 is normal.

When the user U etc. enters that the user U moves the trunk muscles (YES in S101), the recommended setting calculation unit 211 recommends "without backrest" as a recommended setting (S103). The processing system 200 then asks the user U etc. whether to move the erector spinae more (S104).

When the user U etc. enters information that the user U moves the erector spinae less (NO in S104), the recommended setting calculation unit 211 recommends that the installation distance between the main body 20 and the chair 10 be small (S105). The output unit 230 outputs "without backrest" and "small installation distance between the main body 20 and the chair 10" as recommended settings. The user U sits on the chair 10 with no backrest portion 12. The user U performs a pedaling exercise with a small installation distance between the main body 20 and the chair 10.

When the user U etc. enters information that the user U moves the erector spinae more (YES in S104), the recommended setting calculation unit 211 recommends that the installation distance between the main body 20 and the chair 10 be large (S106). The output unit 230 outputs "without backrest" and "large installation distance between the main body 20 and the chair 10" as recommended settings. The user U sits on the chair 10 with no backrest portion 12. The user U then performs a pedaling exercise with a large installation distance between the main body 20 and the chair 10. The process thus ends.

FIG. 9 shows a process of calculating recommended settings for the following setting items: with or without tilt of the pedal 31, and the installation distance between the main body 20 and the chair 10. As shown in FIG. 9, the processing system 200 asks the user U etc. whether to pedal in the dorsiflexion range of the ankle joint (S201). When the user U etc. enters that the user U does not pedal in the dorsiflexion range of the ankle joint (NO in S201), the recommended setting calculation unit 211 recommends "no pedal tilt" (S202). The output unit 230 outputs "no pedal tilt" as a recommended setting. That is, the user U performs a pedaling exercise without the adjusting member 38 for tilting the pedal 31 in the dorsiflexion direction.

When the user U etc. enters that the user U pedals in the dorsiflexion range of the ankle joint (YES in S201), the recommended setting calculation unit 211 recommends "pedal tilt" (S203). The processing system 200 then asks the user U etc. whether to move the soleus (deep muscle) more (S204).

When the user U etc. enters that the user U moves the soleus less (NO in S204), the recommended setting calculation unit 211 recommends that the installation distance between the main body 20 and the chair 10 be large (S205). The output unit 230 outputs "pedal tilt" and "large installation distance between the main body 20 and the chair 10" as recommended settings. The user U etc. attaches the adjusting member 38 for tilting the pedal 31 in the dorsiflexion direction. The user U performs a pedaling exercise with a large installation distance between the main body 20 and the chair 10.

When the user U etc. enters that the user U moves the soleus more (YES in S204), the recommended setting calculation unit 211 recommends that the installation distance between the main body 20 and the chair 10 be small (S206). The output unit 230 outputs "pedal tilt" and "small installation distance between the main body 20 and the chair 10" as recommended settings. The user U etc. attaches the adjusting member 38 for tilting the pedal 31 in the dorsiflexion direction. The user U performs a pedaling exercise with a small installation distance between the main body 20 and the chair 10. The process thus ends.

FIG. 10 shows a process of calculating recommended settings for the following setting items: with or without the tilted base 50, and the installation distance between the main body 20 and the chair 10. As shown in FIG. 10, the processing system 200 asks the user U etc. whether to pedal in the plantarflexion range of the ankle joint (S301). When the user U etc. enters that the user U does not pedal in the plantarflexion range of the ankle joint (NO in S301), the recommended setting calculation unit 211 recommends "without tilted base" (S302). The output unit 230 outputs "without tilted base" as a recommended setting. That is, the user U performs a pedaling exercise without the tilted base 50 for tilting the pedal 31 in the plantarflexion direction.

When the user U etc. enters that the user U pedals in the plantarflexion range of the ankle joint (YES in S301), the recommended setting calculation unit 211 recommends "with tilted base" (S303). The processing system 200 then asks the user U etc. whether to move the gastrocnemius (S304).

When the user U etc. enters that the user U does not move the gastrocnemius (NO in S304), the recommended setting calculation unit 211 recommends that the installation distance between the main body 20 and the chair 10 be large (S305). The output unit 230 outputs "with tilted base" and "large installation distance between the main body 20 and the chair 10" as recommended settings. The user U attaches the tilted base 50 for tilting the pedal 31 in the plantarflexion direction. The user U then performs a pedaling exercise with a large installation distance between the main body 20 and the chair 10.

When the user U etc. enters that the user U moves the gastrocnemius (YES in S304), the recommended setting calculation unit 211 recommends that the installation distance between the main body 20 and the chair 10 be small (S306). The output unit 230 outputs "with tilted base" and "small installation distance between the main body 20 and the chair 10" as recommended settings. The user U attaches the tilted base 50 for tilting the pedal 31 in the plantarflexion direction and performs a pedaling exercise. At this time, the distance between the main body 20 and the chair 10 in the anteroposterior direction is small. The process thus ends.

In the above processes, any setting item for which there is no recommended setting may be set to a reference setting. That is, parameters (numerical values, levels, with or without equipment, etc.) that are reference settings can be provided in advance for each setting item. For any setting item for which there is no recommended setting, the user U can train with a parameter that is a reference setting. The parameters that are reference settings may be changed for each user. That is, the parameters that are reference settings can be changed according to the user data.

The recommended setting may be any setting that indicates a change from the reference setting, such as raising or lowering of the level from or to a reference level. For example, when the reference setting is "without equipment," the recommended setting can be "with equipment." Alternatively, when the reference setting is "with equipment," the recommended setting can be "without equipment." It is also possible to use the reference setting as a recommended setting. When the reference setting is "with equipment," the recommended setting can be "with equipment." The recommended setting may be a specific numerical value or numerical range.

A training system that can be personalized according to the user U can thus be provided. For example, the user U can do optimal training by entering the muscle site he or she wants to build and the amount of load to be placed on the muscle site. For the injured user U, it is possible to set a parameter that reduces the load on the injured part.

In the processing system 200, the setting items of the exerciser 100 are linked to the muscle sites. The processing system 200 links the muscle sites to the setting items that are highly correlated with the muscle sites, and stores them in the memory etc. The recommended setting calculation unit 211 can obtain appropriate recommended settings for each user U. That is, the processing system 200 can efficiently propose training parameters suitable for each user U.

The simulator 212 simulates the load placed on each muscle site by changing the parameters of the setting items of the exerciser 100. The simulator 212 calculates a change in muscle activity with time during one rotation of the crank 40. The recommended setting calculation unit 211 calculates the recommended settings based on the simulation results. For example, the recommended setting calculation unit 211 calculates the recommended settings by referring to the simulation results for a physique similar to the user data. Appropriate recommended settings can thus be calculated. The recommended setting calculation unit 211 can recommend appropriate numerical values and levels as the parameters of the setting items. Therefore, effective training can be performed.

The user U etc. may enter a deep muscle such as soleus as a muscle site the user U wants to build. It is thus possible to effectively place a load on deep muscles that are difficult to build by normal training. Therefore, training can be effectively performed.

Figure 11:
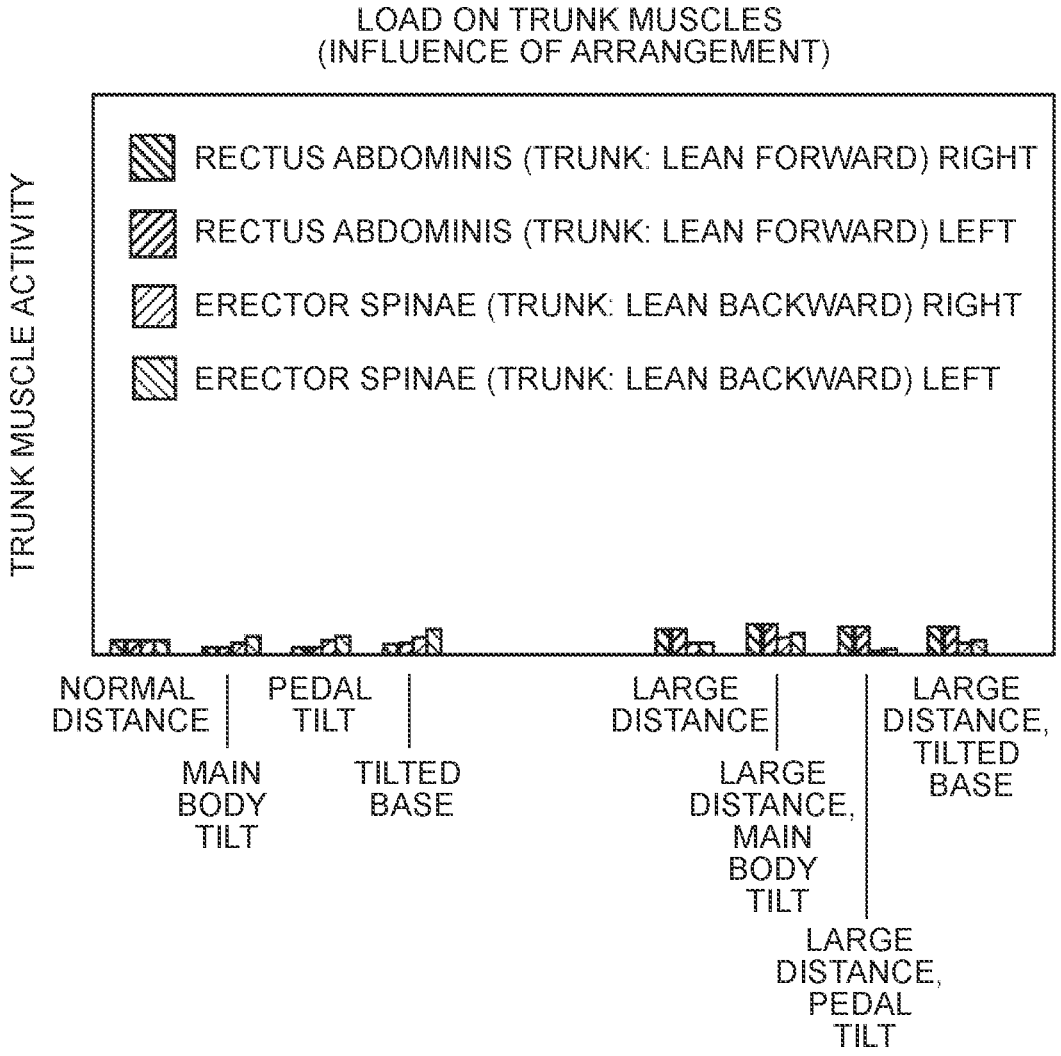
FIG. 11 is a graph showing simulation results of a load placed on muscle sites of the trunk.
Figure 12:
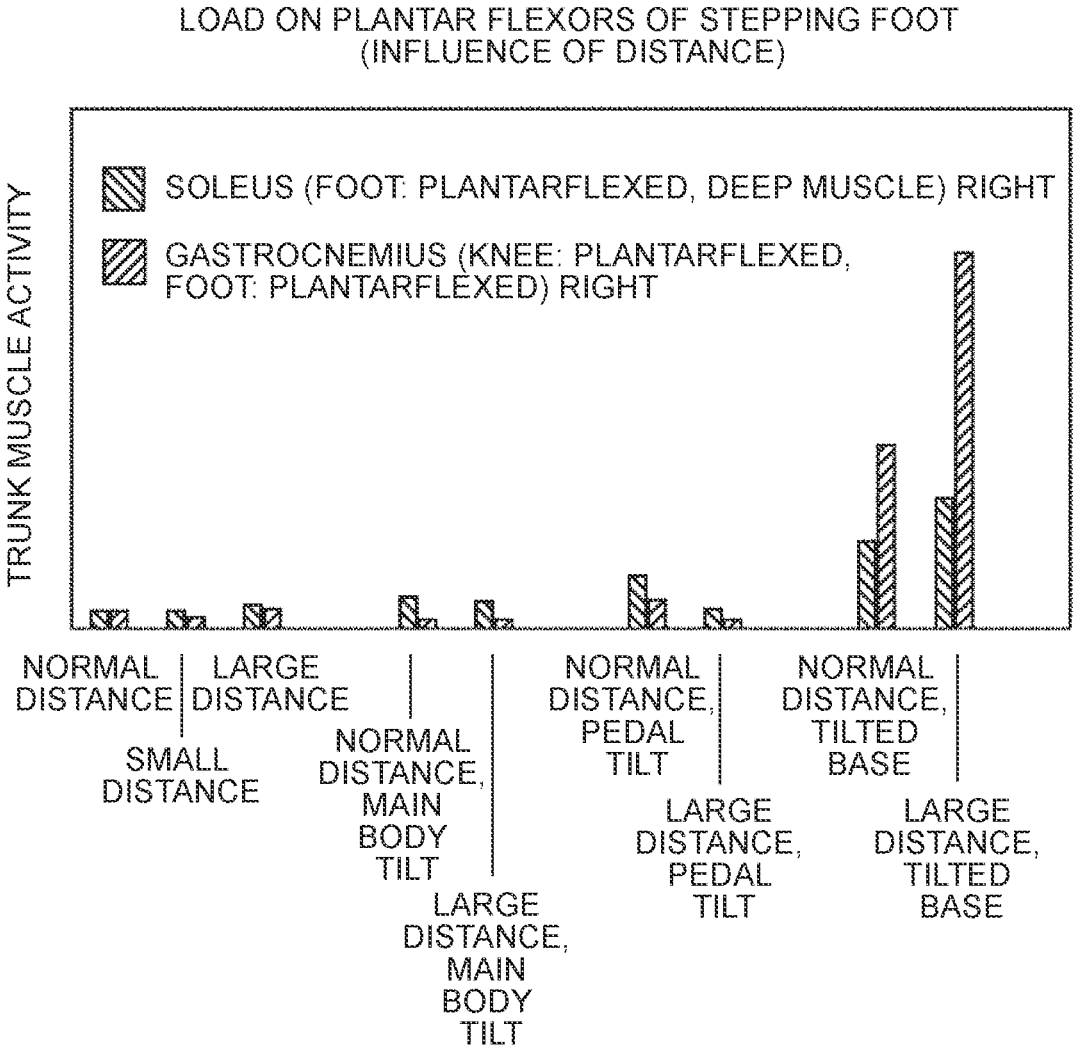
FIG. 12 is a graph showing simulation results of a load placed on plantar flexors.

FIGS. 11 and 12 are graphs each showing an example of the simulation results of the simulator. FIG. 11 is a graph showing changes in load due to the geometrical arrangement. Specifically, FIG. 11 shows the muscle activities of the right and left rectus abdominis muscles and the right and left erector spinae muscles. FIG. 11 shows the simulation results for the reference settings (FIG. 4A), main body tilt (FIG. 5A), pedal tilt (FIG. 6A), and with tilted base (FIG. 7A) when the installation distance is normal. FIG. 11 also shows the simulation results for the reference settings with the large installation distance (FIG. 4C), large installation distance and main body tilt (FIG. 5B), large installation distance and pedal tilt (FIG. 6B), and large installation distance and with tilted base (FIG. 7B).

As shown in FIG. 11, when the installation distance is normal and the geometrical arrangement is changed, the muscle activity of the rectus abdominis is lower in the case of main body tilt, pedal tilt, and with tilted base than in the case of the reference settings. Even when the installation distance is large and the geometrical arrangement is changed, there is almost no change in muscle activity of the rectus abdominis.

FIG. 12 is a graph showing changes in load according to the installation distance. FIG. 12 shows the muscle activities of the soleus and the gastrocnemius. In FIG. 12, the parameter of the installation distance is changed among normal distance, small distance, and large distance in the reference settings (see FIGS. 4A to 4C). FIG. 12 also shows the simulation results for main body tilt (see FIGS. 5A and 5B), pedal tilt (see FIGS. 6A and 6B), and with tilted base (see FIGS. 7A and 7B). In the simulation results for main body tilt (see FIGS. 5A and 5B), pedal tilt (see FIGS. 6A and 6B), and with tilted base (see FIGS. 7A and 7B), the installation distance is changed between normal distance and large distance.

As shown in FIG. 12, the muscle activity for pedal tilt is lower when the installation distance is large than when the installation distance is normal. The muscle activity for with tilted base is higher when the installation distance is large than when the installation distance is normal. Therefore, the parameters can be determined as in the flowchart of FIG. 9.

FIGS. 13 to 22 are graphs showing the simulation results of the simulator. FIGS. 13 to 22 are graphs showing changes in muscle activity of each muscle site when the crank angle is changed. In FIGS. 13 to 22, the abscissa represents the crank angle, and the ordinate represents the muscle activity. FIGS. 13, 15, 17, 19, and 21 are graphs showing the muscle activities of the right half of the body. FIGS. 14, 16, 18, 20, and 22 are graphs showing the muscle activities of the left half of the body.

FIGS. 13 and 14 are graphs showing the simulation results for the reference settings (FIG. 4A). FIGS. 15 and 16 are graphs showing the simulation results for the small installation distance (FIG. 4B). FIGS. 17 and 18 are graphs showing the simulation results for the large installation distance (FIG. 4C). FIGS. 19 and 20 show the simulation results for pedal tilt (FIG. 6A). FIGS. 21 and 22 show the simulation results for with tilted base (FIG. 7A).

The simulator 212 dynamically calculates the muscle activities. That is, the simulator 212 calculates the muscle activities according to the crank angle due to pedaling. For example, the simulator 212 changes the crank angle by fixed increments and calculates the muscle activities at each crank angle. The simulator 212 calculates the muscle activity of each muscle site. The muscle activity changes by changing the installation distance and the geometrical arrangement. Accordingly, the muscle site to be built can be changed by changing the parameters of the exerciser 100. As described above, the processing system 200 can thus calculate appropriate recommended settings according to the acquired muscle site data.

The processing system 200 may be shared by a plurality of exercisers 100. That is, one computer may be installed as the processing system 200 in a rehabilitation center etc. where a plurality of exercisers 100 is installed. The computer served as the processing system 200 can calculate recommended settings for the plurality of exercisers 100. The processing of the recommended setting calculation unit 211 and the simulator 212 may be performed by a server device, and the processing of the input unit 201 and the output unit 230 may be performed by an edge device or terminal on the user U side. The human body computer model is not limited to the human body finite element model, and may be other human body models.

A part or all of the above processing of the processing system 200 etc. can be implemented as a computer program. Such a program can be stored using various types of non-transitory computer-readable media and supplied to a computer. The non-transitory computer-readable media include various types of tangible recording media. Examples of the non-transitory computer-readable media include magnetic recording media (e.g. flexible disks, magnetic tapes, and hard disk drives), magneto-optical recording media (e.g. magneto-optical disks), compact disc read-only memory (CD-ROM), compact disc recordable (CD-R), compact disc rewritable (CD-RW), and semiconductor memories (e.g. mask ROM, programmable ROM (PROM), erasable PROM (EPROM), flash ROM, random access memory (RAM)). The program may also be supplied to the computer by various types of transitory computer-readable media. Examples of the transitory computer-readable media include electrical signals, optical signals, and electromagnetic waves. The transitory computer-readable media can supply the program to the computer via a wired communication path such as electric wire and optical fiber, or a wireless communication path.

The present disclosure is not limited to the above embodiment, and can be modified as appropriate without departing from the spirit and scope of the present disclosure.

What is claimed is:

1. An exercise system comprising:

an exerciser including a main body, a link, a crank, a tilted base, and an installation base that is configured to removably support a front portion of the main body, the crank being rotatably connected to the main body, the link being attached on the crank and having a pedal and a sliding wheel, the sliding wheel configured to slide on a tilted surface of the tilted base, and the tilted base configured to tilt the pedal in a plantarflexion direction;

a processor configured to:

acquire user data including physical information of a user;

acquire muscle site data including: (i) at least one muscle site desired to be built and (ii) a desired amount of load to be placed on the at least one muscle site;

calculate, based on the acquired user data and the acquired muscle site data, a plurality of recommended settings for a plurality of setting items of the exerciser that place the desired amount of load on the at least one muscle site of the user, wherein each of the plurality of recommended settings indicate a geometrical arrangement of the exerciser linked to the at least one muscle site, and wherein the plurality of setting items include an installation angle of the main body, a tilt angle of the pedal, a tilt angle of the tilted base, and a position of the tilted base relative to the main body in an anteroposterior direction; and output the recommended settings; and one or more sensors operatively connected to the processor and configured to detect data regarding the geometric arrangement of the exerciser, wherein the processor is configured to calculate the plurality of recommended settings by:

performing, for a human body model with a physique similar to the user data, multiple simulations of variations of the geometrical arrangement of the exerciser that simulate various loads placed on various muscle sites by changing a parameter of one or more setting items of the plurality of setting items, obtaining simulation results of the multiple simulations performed, and calculating, based on the obtained simulation results, the setting items that are correlated to the at least one muscle site desired to be built and the desired amount of load to be placed on the at least one muscle site as the plurality of recommended settings.

2. The exercise system according to claim 1, wherein the at least one muscle site desired to be built includes a deep muscle.

3. The exercise system according to claim 1, wherein the processor is configured to determine, using the detected data from the one or more sensors, whether the exerciser is operating with the plurality of recommended settings.

4. The exercise system according to claim 1, further comprising a wedge-shaped block attached to the pedal and configured to tilt the pedal.

5. The exercise system according to claim 1, further comprising a chair, wherein the plurality of setting items further include a distance between the chair and the main body in an anteroposterior direction.

* * * * *